US009963943B1

(12) United States Patent
Lafferty et al.

(10) Patent No.: US 9,963,943 B1
(45) Date of Patent: May 8, 2018

(54) METHOD AND APPARATUS FOR SALVAGING AN OIL WELL TUBULARS

(71) Applicant: TETRA Technologies, Inc., The Woodlands, TX (US)

(72) Inventors: Ames Lafferty, Lafayette, LA (US); John Hawkins, Grand Coteau, LA (US); Tara Landry, Lafayette, LA (US)

(73) Assignee: EPIC APPLIED TECHNOLOGIES, LLC, The Woodlands, TX (US)

( * ) Notice: Subject to any disclaimer, the term of this patent is extended or adjusted under 35 U.S.C. 154(b) by 375 days.

(21) Appl. No.: 14/795,564

(22) Filed: Jul. 9, 2015

(51) Int. Cl.
*E21B 19/00* (2006.01)

(52) U.S. Cl.
CPC ..... *E21B 19/00* (2013.01)

(58) Field of Classification Search
CPC ..... E21B 19/00
USPC ..... 166/298, 361, 363, 364
See application file for complete search history.

(56) References Cited

U.S. PATENT DOCUMENTS

| | | | |
|---|---|---|---|
| 2,150,381 | A | 3/1939 | Lansing |
| 2,390,420 | A | 12/1945 | Burke |
| 2,449,429 | A | 9/1948 | Degrift |
| 2,795,222 | A | 6/1957 | Garrison |
| 3,056,267 | A | 10/1962 | McRee |
| 3,266,199 | A | 8/1966 | Bryson |
| 3,479,830 | A | 11/1969 | Ostarly |
| 3,578,233 | A | 5/1971 | Meister et al. |
| 3,826,585 | A | 7/1974 | Horton et al. |
| 3,847,501 | A | 11/1974 | Doty |
| 3,933,519 | A | 1/1976 | Koch et al. |
| 4,109,480 | A | 8/1978 | Summer |
| 4,146,350 | A | 3/1979 | Bokelmann |
| 4,180,047 | A | 12/1979 | Bertelsen |
| 4,234,268 | A | 11/1980 | Scodino |
| 4,765,307 | A | 8/1988 | Kubo |
| 4,777,723 | A | 8/1988 | Southoff |
| 4,787,363 | A | 11/1988 | Kubo |
| 4,860,413 | A | 8/1989 | Woodward |
| 4,902,174 | A | 2/1990 | Thompson et al. |
| 4,936,284 | A | 6/1990 | Johnson |
| 5,025,842 | A | 6/1991 | Brimhall |
| 5,044,827 | A | 9/1991 | Gray et al. |
| 5,361,748 | A | 11/1994 | Matteucci |

(Continued)

*Primary Examiner* — Michael R Wills, III
(74) *Attorney, Agent, or Firm* — Brett A. North

(57) ABSTRACT

The present invention is directed to a method of salvaging an elongated oil well tubular that extends downwardly from an oil well platform as well as a saw apparatus of improved configuration. The method includes supporting the tubular in a generally upright or vertical position. A cutting apparatus is placed next to the tubular. The cutting apparatus includes a frame that supports a lifting device and a rotary cutter. The lifting device moves the rotary cutter from a first position to a second position that is higher than the first position. The second position is closer to the tubular than the first position. The rotary cutter can travel in an arcuate path when moving from the first position to the second position. The cutter moves along a selected path to cut the tubular. After cutting, the cut section is removed and the tubular then elevated so that an additional cut can be made. This procedure is repeated multiple times until the tubular has been salvaged, cut into many smaller pieces or sections.

19 Claims, 40 Drawing Sheets

(56) References Cited

U.S. PATENT DOCUMENTS

| | | | | |
|---|---|---|---|---|
| 5,509,440 | A * | 4/1996 | Cantaloube | B23D 45/003 137/318 |
| 5,893,636 | A | 4/1999 | Weiler | |
| 6,267,037 | B1 * | 7/2001 | McCoy, Jr. | B23D 57/0007 83/745 |
| 6,827,145 | B2 | 12/2004 | Fotland et al. | |
| 7,036,599 | B2 | 5/2006 | Matteucci | |
| 7,156,170 | B2 * | 1/2007 | Fotland | E21B 19/165 166/298 |
| 7,708,058 | B1 * | 5/2010 | Gipson | E21B 19/22 166/77.1 |
| 7,922,424 | B2 | 4/2011 | Clark, II | |
| 8,250,816 | B2 * | 8/2012 | Donnally | E21B 7/023 52/117 |
| 8,307,888 | B1 | 11/2012 | Remedies et al. | |
| 9,249,634 | B1 * | 2/2016 | Streety | E21B 19/00 |
| 2002/0076285 | A1 | 6/2002 | Tsune | |
| 2011/0100638 | A1 * | 5/2011 | Ramfjord | B23D 21/04 166/361 |
| 2012/0048535 | A1 * | 3/2012 | Ruttley | E21B 19/00 166/85.1 |
| 2013/0319674 | A1 * | 12/2013 | Boudreaux | E21B 19/00 166/297 |

* cited by examiner

METHOD AND APPARATUS FOR SALVAGING AN OIL WELL TUBULARS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved cutting method and apparatus for cutting abandoned oil and gas well tubulars.

2. General Background of the Invention

When offshore well platforms are at the end of life cycle, or are damaged, they must be removed. Such a removal or remediation involves cutting up of various tubulars (e.g., tubing/casing) into sections for transport via marine vessel to a final destination on land. In order to save as much time as possible, cuts should be made effectively and efficiently. The present invention provides an improved cutting apparatus and method for removing such abandoned tubulars in a marine environment.

BRIEF SUMMARY OF THE INVENTION

The present invention provides an improved method of salvaging an elongated oil well tubular that extends downwardly from an oil well platform. The method includes supporting the tubular in a generally vertical or upright position.

A cutting apparatus is positioned next to the tubular. The cutting apparatus includes a frame that supports a lifting device and a rotary cutter.

The lifting device is used to move the rotary cutter from a first position to a second position that is higher than the first position and that is closer to the tubular than the first position.

The rotary cutter travels in an arcuate path when moving from the first position to the second position.

The cutter moves along a selected path to cut the tubular.

These steps are then repeated multiple times in order to cut the tubular into multiple and smaller sections.

In one embodiment, the rotary cutter is hydraulically powered.

In one embodiment, the lifting device is hydraulically powered.

In one embodiment, the rotary cutter is operated from a remote location with a hydraulic control panel.

In one embodiment, the lifting device is operated from a remote location with a hydraulic control panel.

In one embodiment, the lifting mechanism frame includes a base and a lift section pivotally attached to the base.

In one embodiment, a hydraulic cylinder having a push-rod extends when the hydraulic cylinder elevates the lift section.

In one embodiment, the lift section has one or more rails and the method includes moving the cutter upon the rails.

In one embodiment, the cutter includes a rotary disk connected to a hydraulic motor, a pair of spaced apart rails on the lift section, wherein the disk is positioned in between the rails and further comprising moving the cutter upon the spaced apart rails.

In one embodiment, a clamping device is mounted on the frame and the method includes clamping the tubular before cutting.

The present invention in one embodiment provides a method of salvaging an elongated oil well tubular that extends downwardly from an oil well platform. The method includes supporting the tubular in an upright or generally vertical position.

A cutting apparatus is placed next to the tubular, the cutting apparatus including a frame that supports a lifting device and a rotary cutter.

The lifting device moves the rotary cutter from a first position to a second position that is higher than the first position. The second position is closer to the tubular than the first position.

The rotary cutter travels along an inclined path that gradually elevates the cutter and moves the cutter closer and closer to the tubular.

The cut section of the tubular is elevated and removed after cutting.

The cutter repeats a cut of the tubular multiple times at different, spaced apart locations.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 6 is an overall perspective view of the elevator and cutter of FIG. 3 shown in an extended and fully raised state and having made a cut in the string of tubulars, with the clamp arms now opened to allow the higher joint to be removed and disposed of.

FIG. 7 is an overall perspective view of the elevator and cutter of FIG. 3 shown in an extended and fully raised state and having made a cut in the string of tubulars, with the cut joint being removed and disposed of.

DETAILED DESCRIPTION OF THE INVENTION

Figure 1:
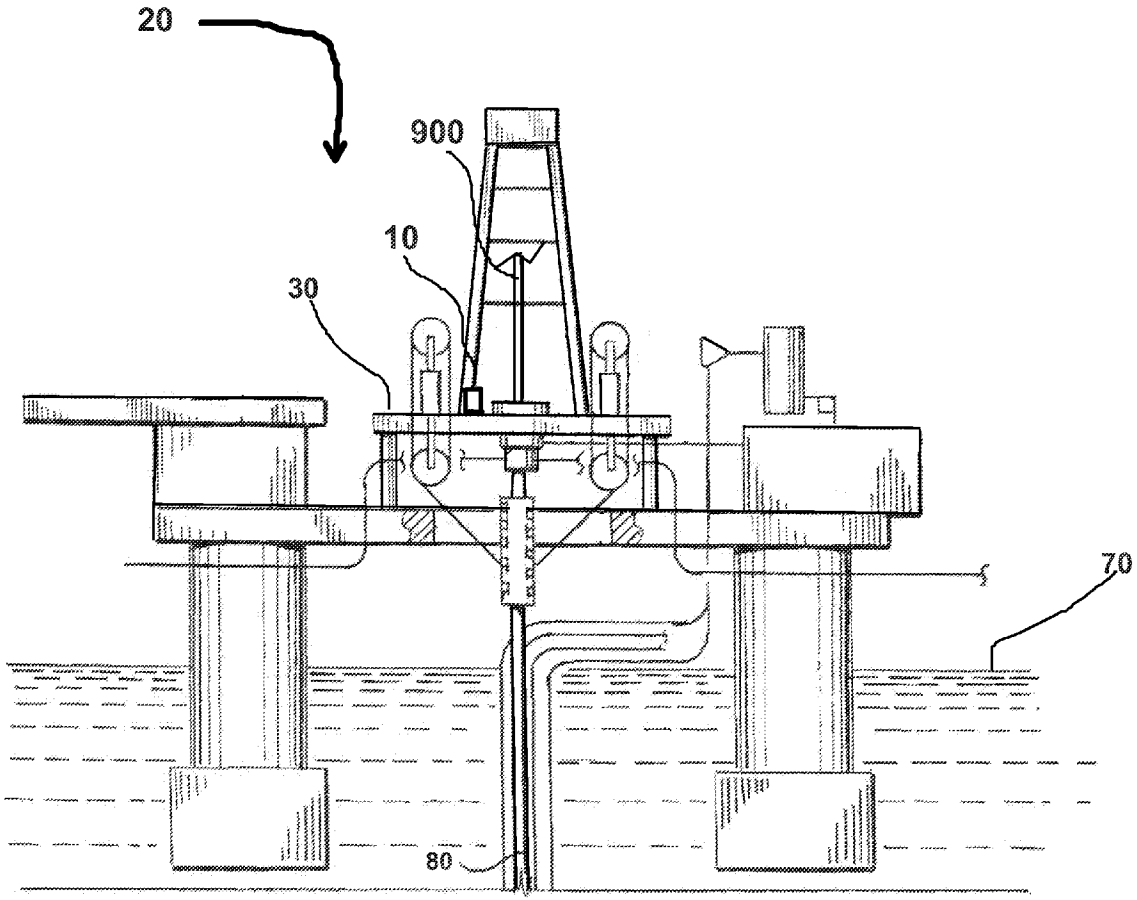
FIG. 1 is a schematic view of a rig showing one embodiment of the elevator and cutter.
Figure 2:
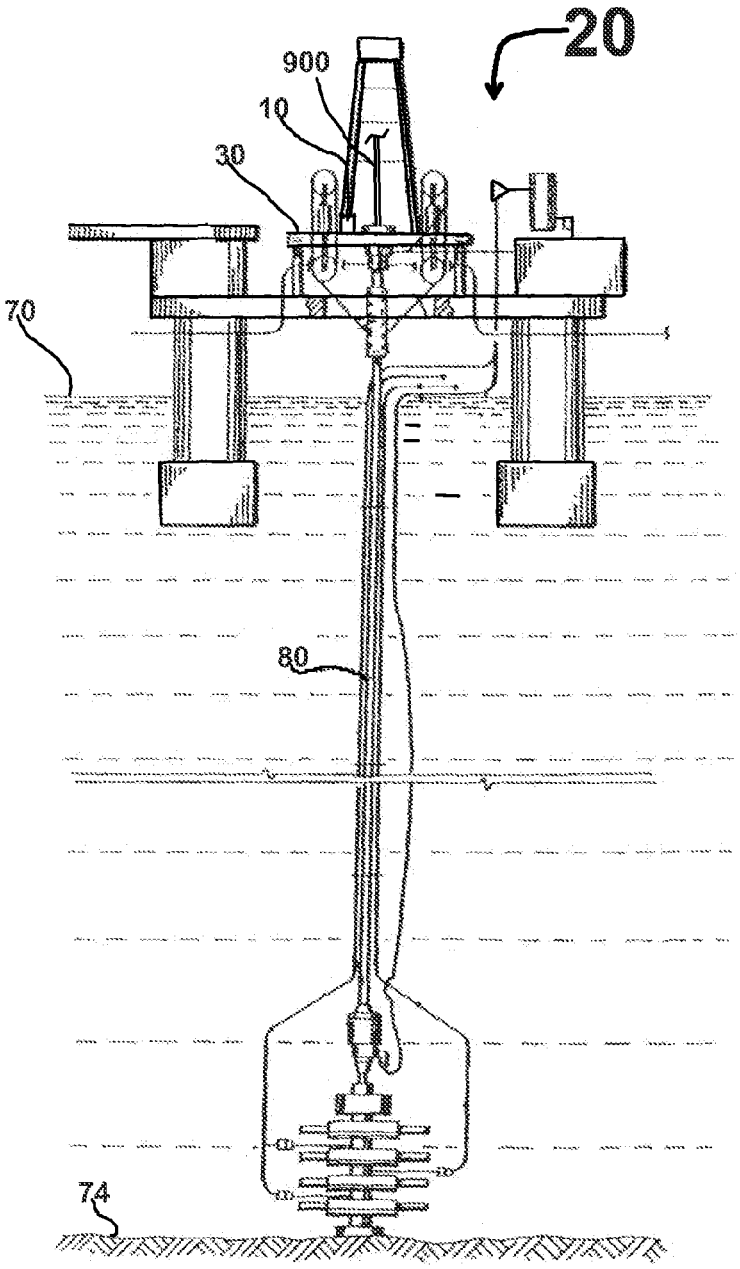
FIG. 2 is the view of FIG. 1 shown down to the seabed.

FIGS. 1-39 show one embodiment of a the apparatus of the present invention designated generally by the numeral 10 in FIGS. 1-40. FIG. 1 is a schematic view of a rig 20 showing one embodiment 10 of the elevator and cutter. FIG. 2 is the view of rig 20 with embodiment 10, and showing the riser 80 down to the seabed 74.

Apparatus

Drilling rig 20 can have a deck 30, a rotary table or gimble 32 and an area of exposure that is designated generally by the numeral 34. A draw works, crane or top drive 50 and rigging 60 can be used to support and lift tubing string, pipeline or tubular 900. The tubular 900 is supported in a generally upright or generally vertical position by draw works, crane, or top drive 50.

The numeral 900 designates a tubular such as a pipeline or a tubing string 900 to be salvaged and cut up into sections using saw unit 200. Tubing string 900 can have connections or connectors 919 at spaced apart intervals.

Figure 3:
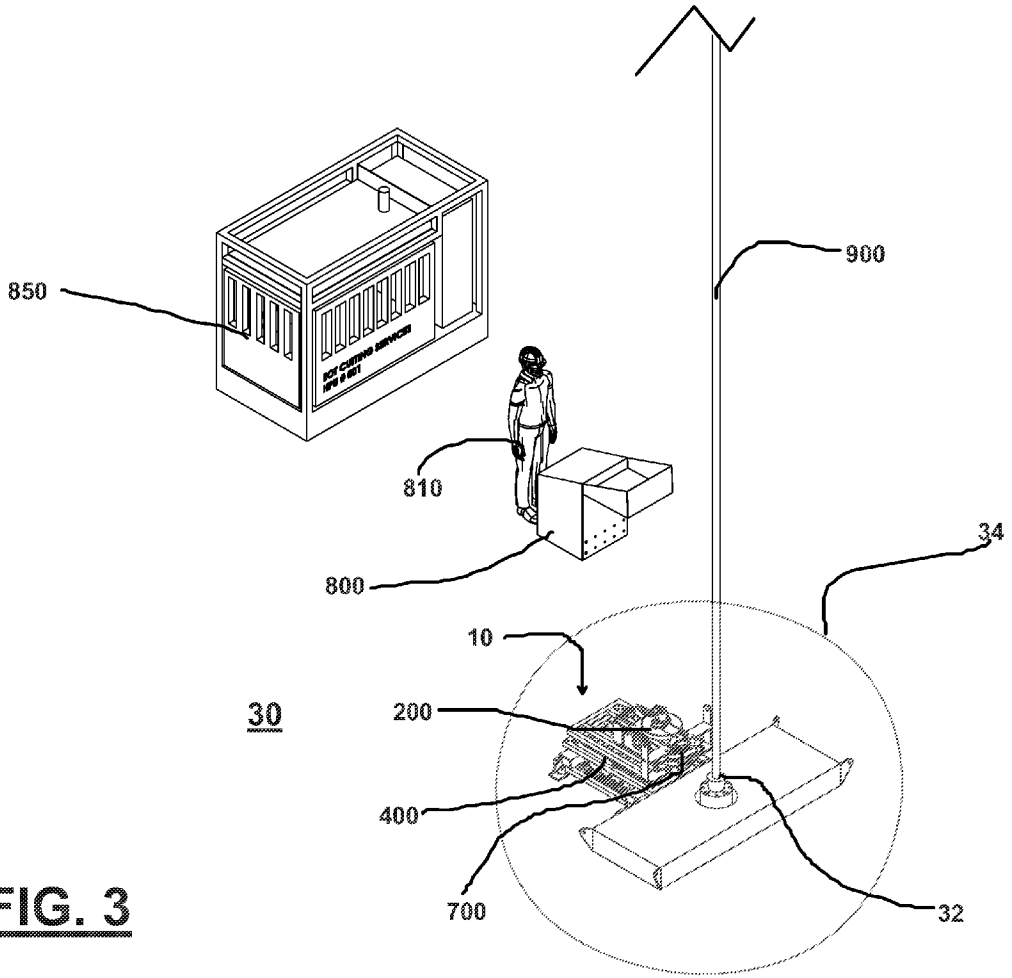
FIG. 3 is an overall perspective view of one embodiment of the elevator and cutter shown in a retracted and lowered state.

In FIG. 3, other items of equipment or personnel provided on the platform deck 30 include a hydraulic power unit 850, operators console or control panel 800, an operator 810 to operate the console 800, a hydraulic clamp 700, a saw unit 200, and a saw elevator assembly 400. Hydraulic control panel 800 is provided with controls/levers 820 and instruments 830.

For safety reasons, this area of exposure 34 about the deck 30 is to be avoided by personnel such as operator 810 during salvaging of elongated tubular or tubing string or pipe or piping 900 that extends into a well bore 80.

Figure 7:
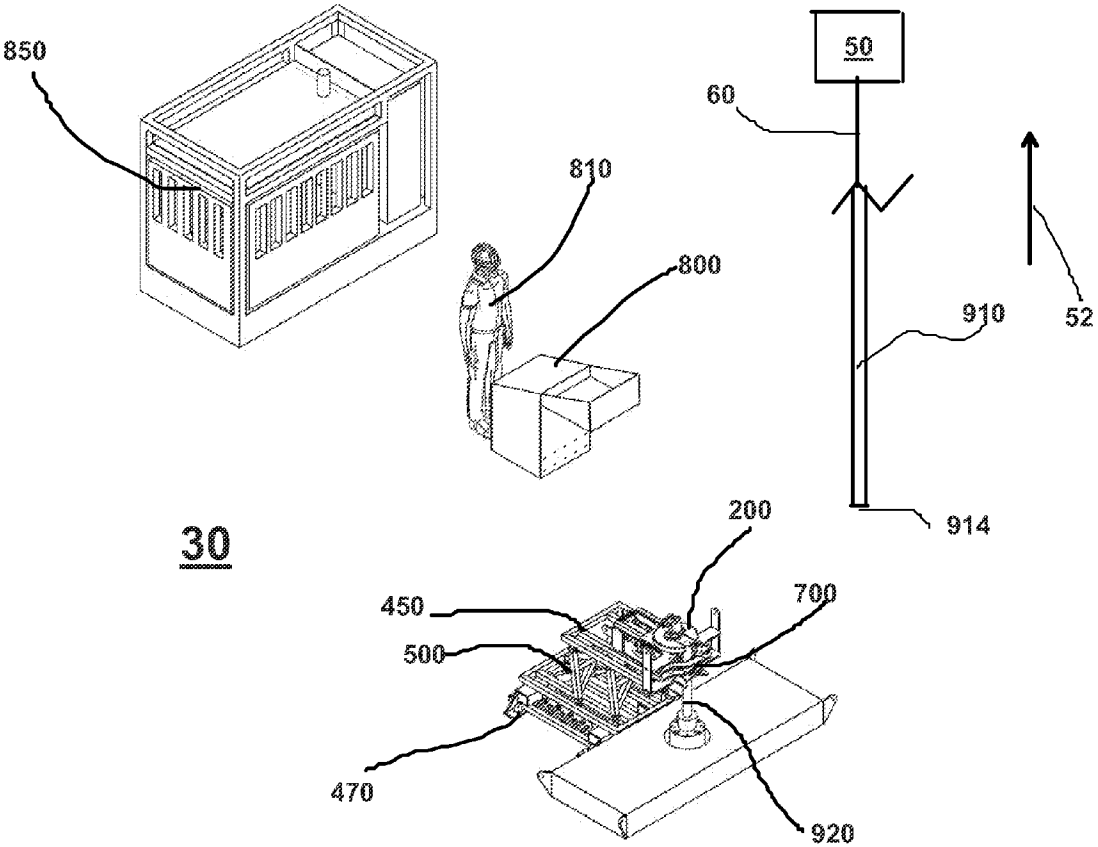

After an upper section or first pipe or tubing section 910 is cut from tubular 900, the cut section 910 is lifted away (arrow 52 in FIG. 7). The bottom of the cut at 911 can be seen in FIG. 13.

Cutting apparatus 10 can be used on a drilling rig 20 to cut and salvage an elongated tubular or tubing string or pipe or piping 900 that extends from a drilling rig 20 and into a riser, casing, and/or well bore 80.

Generally, cutting apparatus 10 can comprise:

(a) a saw 200;

(b) a generally horizontal extender and retractor 268;

(c) an elevator 400;

(d) a clamp 700;

(d) a controller 800;

(e) wherein the saw is attached to the generally horizontal extender and retractor 268, the generally horizontal extender and retractor 268 is attached to the elevator 400, and the clamp 700 is attached to the elevator;

(f) wherein the controller is operatively connected to the saw 200, the generally horizontal extender and retractor 268, the elevator 400, and the clamp 700.

In various embodiments controller 800 can be operatively connected to saw 200, elevator 400, generally horizontal extender and retractor 268, and/or clamp 700; and each of these operatively connected items can be independently controllable by operator 810 operating controller 800.

For example, saw 200 can be operatively controlled by controller 800 while elevator 400, generally horizontal extender and retractor 268, and/or clamp 700 remain static and/or uncontrolled.

As another example, elevator 400 can be operatively controlled by controller 800 while saw 200, generally horizontal extender and retractor 268, and/or clamp 700 remain static and/or uncontrolled.

As another example, generally horizontal extender and retractor 268 can be operatively controlled by controller 800 while saw 200, elevator 400, and/or clamp 700 remain static and/or uncontrolled.

As another example, clamp 700 can be operatively controlled by controller 800 while saw 200, elevator 400, and/or generally horizontal extender and retractor 268 remain static and/or uncontrolled.

As other examples, various sub-groupings of the set of items consisting of saw 200, elevator 400, generally horizontal extender and retractor 268, and clamp 700 can be simultaneously controlled while other sub-groupings of the set of items remain status and/or uncontrolled.

In various other embodiments, one or more automatic control algorithms can be incorporated in controller 800 to automatically control the actions of one or more of saw 200, elevator 400, generally horizontal extender and retractor 268, and/or clamp 700. For example, controller 800 can use a control algorithm to cause saw blade 240 of saw to rotate at a predefined and/or selectively established rotational rate. As another example, elevator 400 can be controlled to raise at a predefined vertical lift rate (and/or lower at a predefined vertical rate). As another example, generally horizontal extender and retractor 268 can be controlled to raise move (extend and/or retract) saw 200 a predefined rate. As another example, clamp 700 can be controlled to clamp tubular 900 at a predefined clamping force. In other embodiments controller 800 is programmable to selectively pick one or more of the pre-defined rotational rate, vertical lift, vertical lower, extension, and/or retraction rates, along with the clamping force.

Each of the major components will be described in more detail below.

Saw 200

Figure 28:
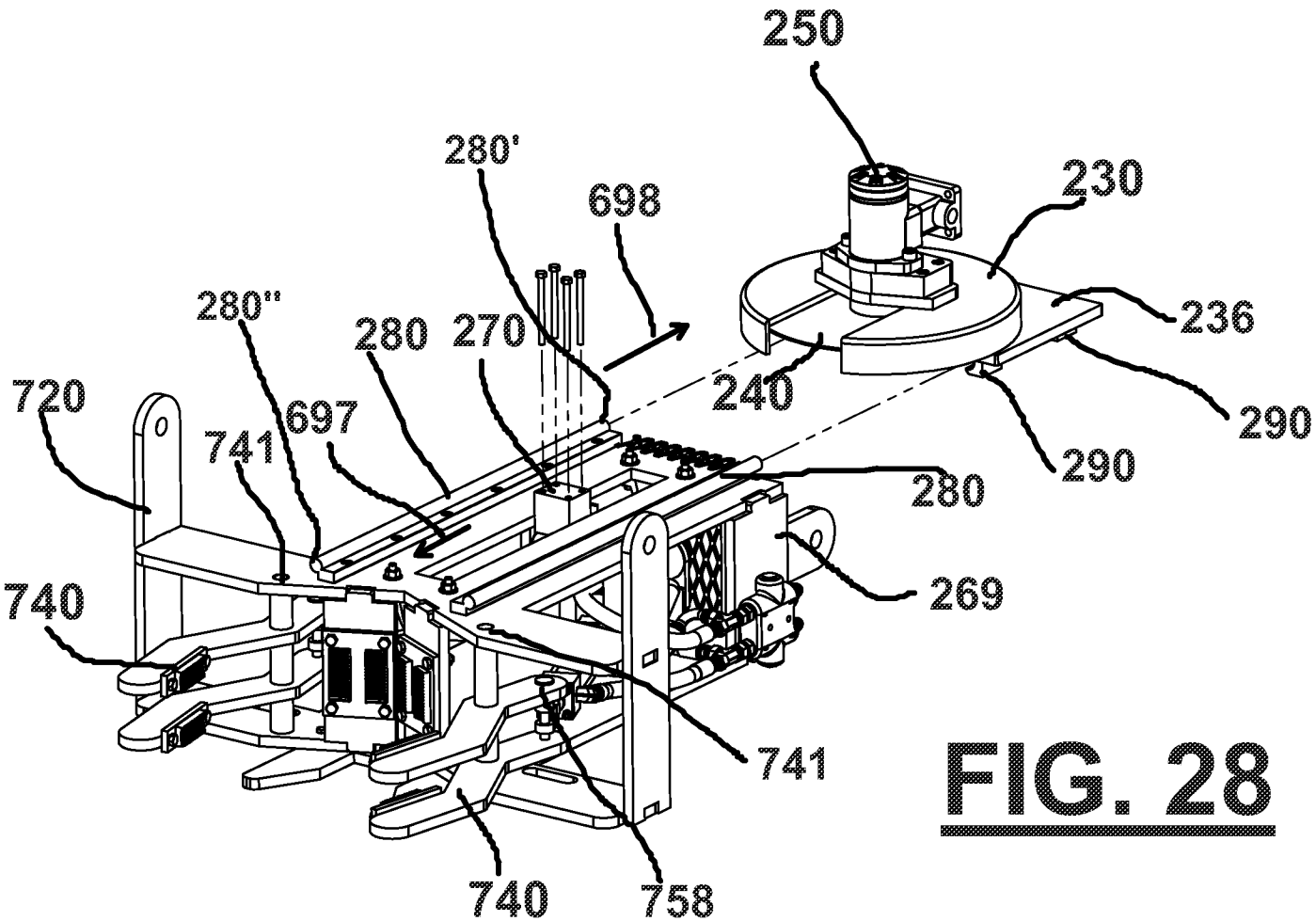
FIG. 28 is a perspective view of the cutter and clamp taken from the front.

FIG. 28 is an enlarged perspective view of saw 200. Saw 200 generally comprises saw blade 240, motor 250 which is operatively connected to saw blade 240, saw blade housing 230 which can be used as a safety guard, and base 290. Saw blade 240 provides saw teeth 244.

Housing 230 can include opening or slot 232 for providing access to cutting by saw blade 240, and receiving tubular 900 as saw blade 240 is advanced from the first position to the second position and in the direction of arrow 697.

Motor 250 rotates the saw blade 240, and can be a hydraulic motor. Motor 250 can be operatively connected to controller 800 such that an operator operating controller 800 can selectively cause motor 250 to rotate saw blade 240 in a selected direction (or a selected opposite direction) and at a selected rotational speed.

Base 236 can have one or more sliders and/or rollers 290, which will be described further in relation to generally horizontal extender and retractor 268, allowing saw to move relative to generally horizontal extender and retractor 268.

Generally Horizontal Extender and Retractor 268

Figure 24:
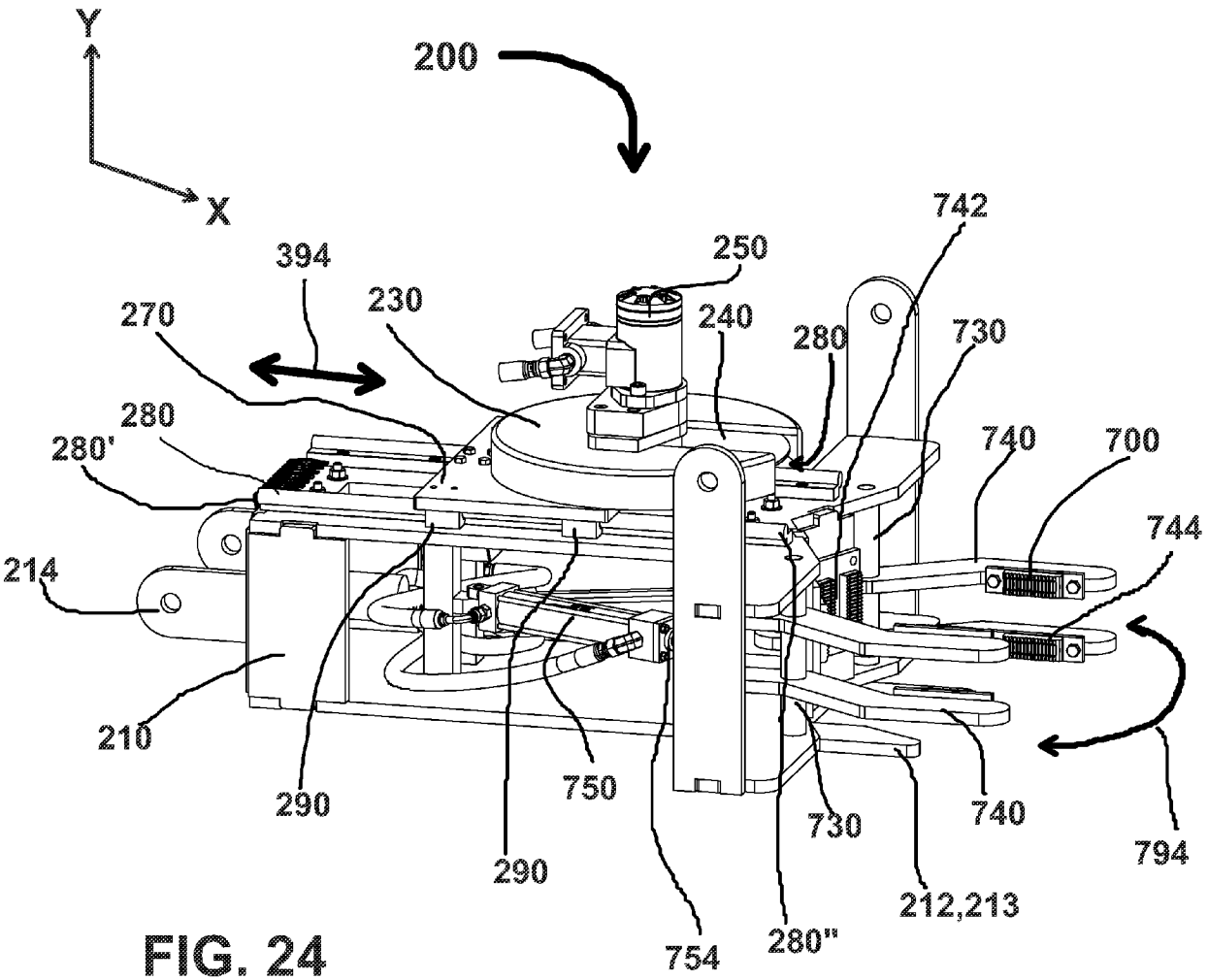
FIG. 24 is a side perspective view of the cutter (without elevator) of FIG. 3 shown in a retracted state, and with the clamp opened.
Figure 25:
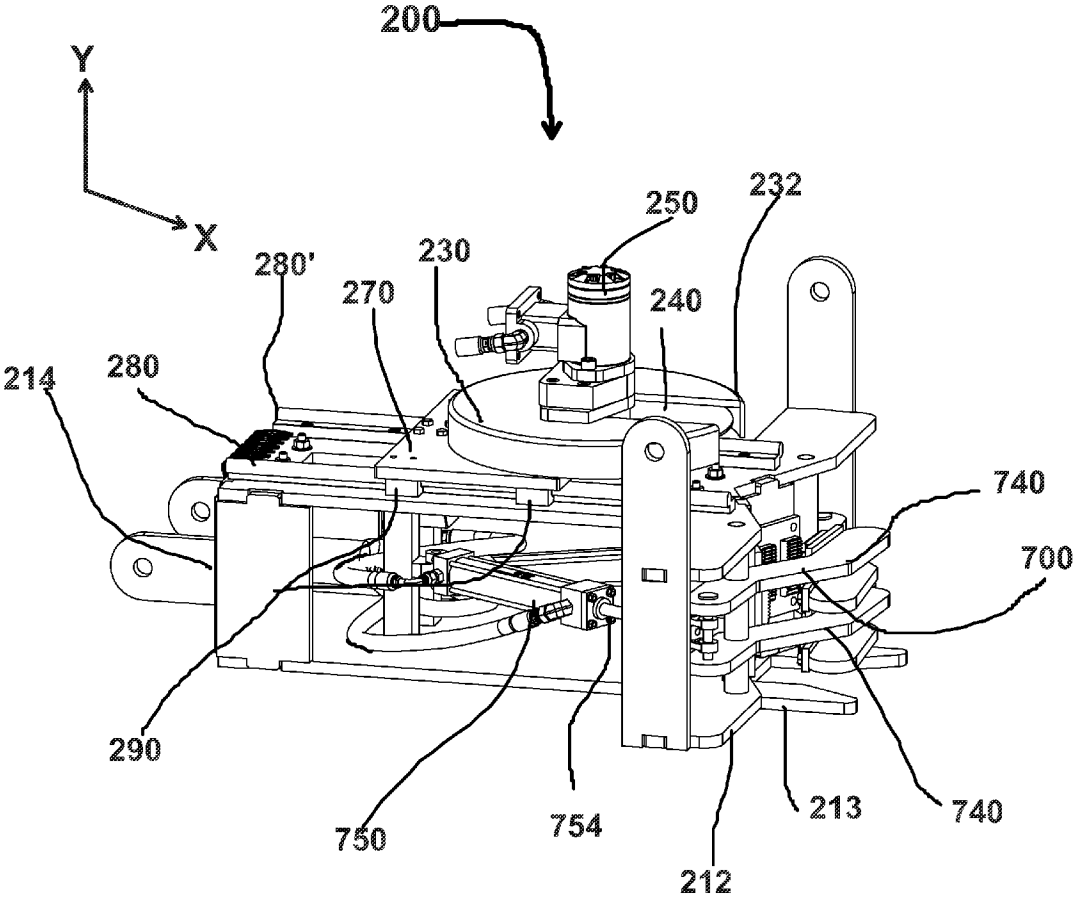
FIG. 25 is a side perspective view of the cutter (without elevator) of FIG. 3 shown in a retracted state, and with the clamp closed.
Figure 26:
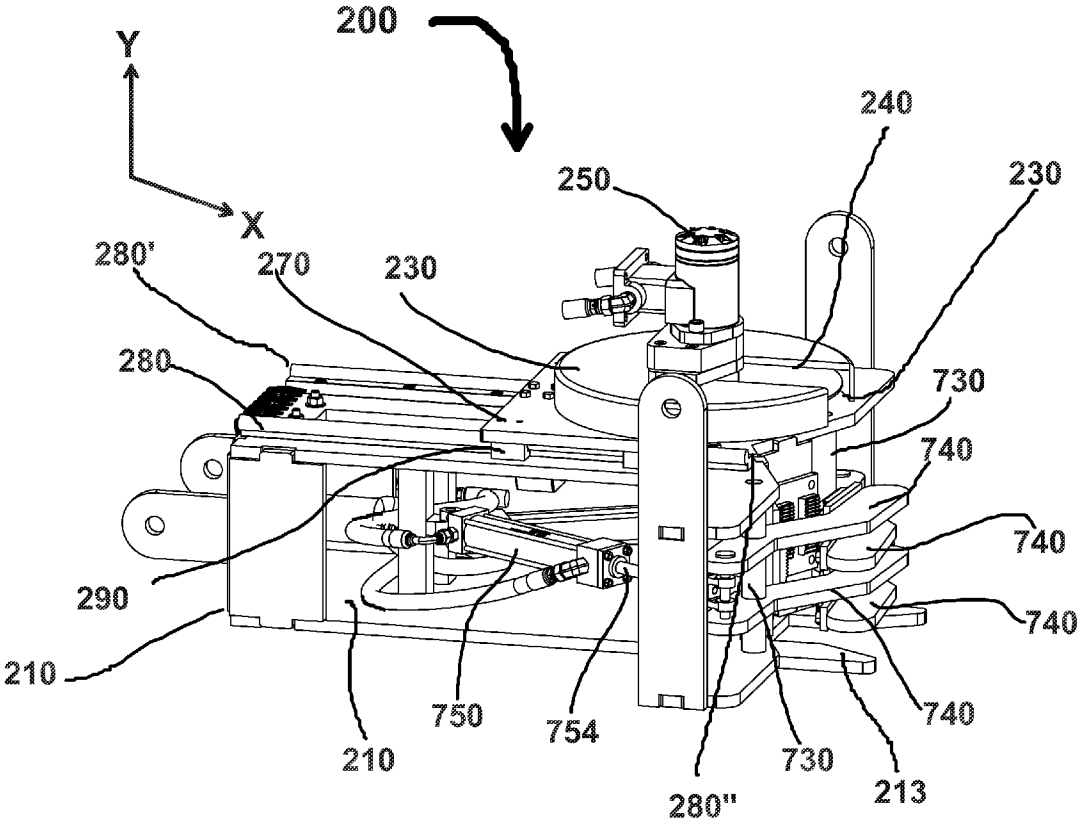
FIG. 26 is a side perspective view of the cutter (without elevator) of FIG. 3 shown in an extended state, and with the clamp closed.
Figure 27:
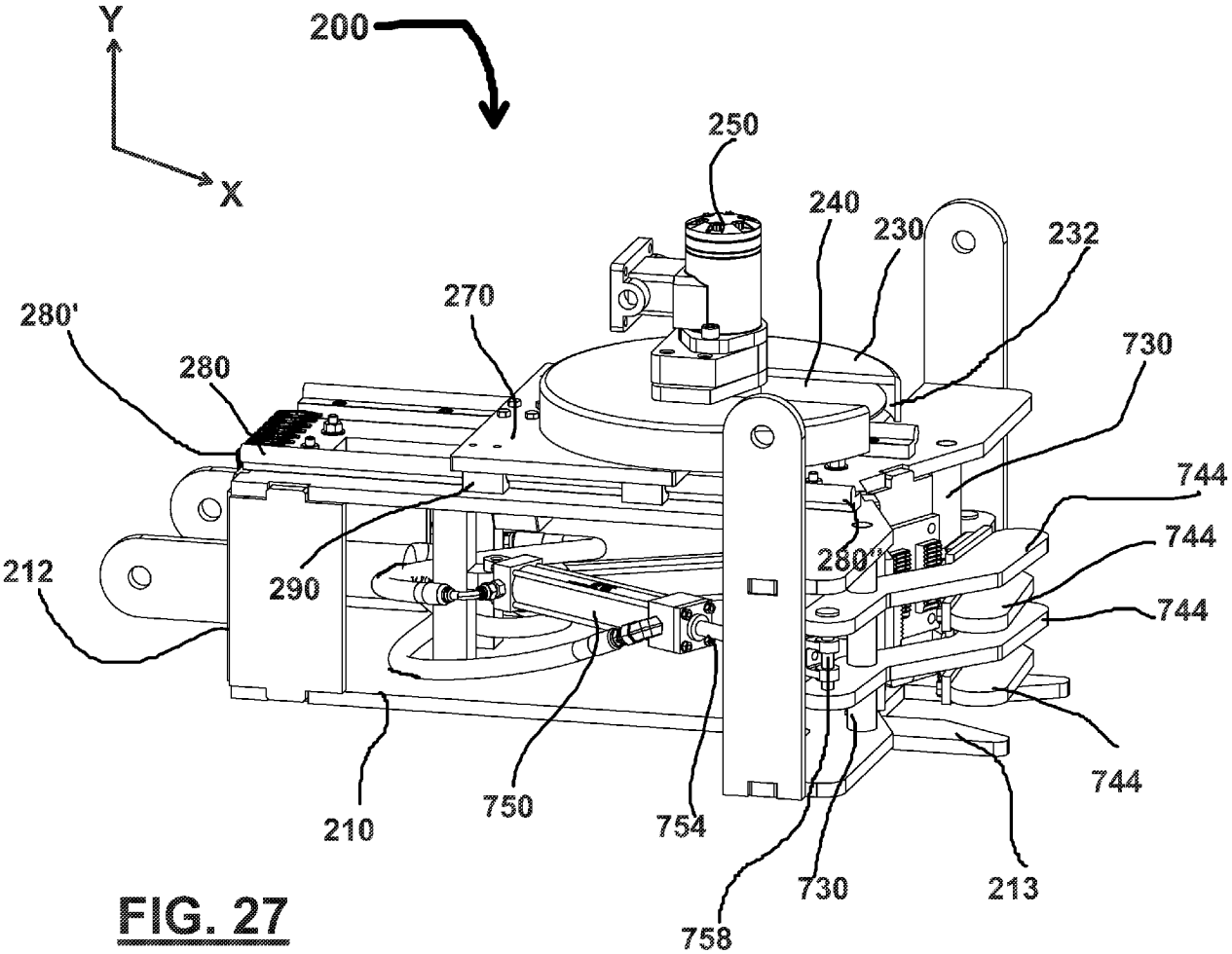
FIG. 27 is a close up side perspective view of the cutter (without elevator) of FIG. 24.

FIGS. 28-39 provide various views of generally horizontal extender and retractor 268. Generally horizontal extender and retractor 268 can be attached to upper end portion 450 of frame 400. FIG. 24 is a side perspective view of the cutter 200 (without elevator 400) shown in a retracted state (schematically indicated by arrows 394), and with the clamp 700 opened. It is noted that saw housing 230 is not completely retracted to first end 280' of track 280, as such complete retraction is not necessary to move saw blade out of the way of tubular 900 while saw 200 is being moved by apparatus 10 to make a cut of tubular 900. FIG. 25 is a side perspective view of the cutter 200 (without elevator 400) shown in a retracted state, and with the clamp 700 closed. FIG. 26 is a side perspective view of the cutter 200 (without elevator 400) shown in an extended state (i.e., closer to end 280" of track 280), and with the clamp 700 closed. This is the extension that will be made during a cut of tubular 900 by saw blade 240. FIG. 27 is a close up side perspective view of the cutter 200 (without elevator 400).

Generally horizontal extender and retractor 268 comprises frame 269, moving portion 270, threaded rod 281, motor 271, gear 272, gear 285, and chain 274.

Moving portion 270 can be slidably connected to frame 269 through a guiding slot 286. Extension (arrow 697) and retraction (arrow 698) of moving portion 270 relative to frame 269 can be obtained by threaded rod 281 threadably engaging a threaded interior of moving portion 270. Threaded rod 281 can be rotatably connected to frame 269 through first 287 and second 288 bearings. Threaded rod 281 can be operatively connected to motor 271 via gears 272 and 285 with connecting chain 274. Motor 271 can be operatively connected to controller 800.

As controller 800 causes motor 271 to turn gear 272 (and through chain and gear 285 threaded rod 281) to rotate in a first direction, the threaded engagement between rod 281 and moving portion 270 can cause moving portion 270 to move in the direction of arrow 697. On the other hand, as controller 800 causes motor 271 causes threaded rod 281 to rotates in a second direction, which is the opposite of the first direction, the threaded engagement between rod 281 and moving portion 270 can cause moving portion 270 to move in the direction of arrow 698, which is the opposite direction as that of arrow 697. The slidable connection between moving portion 270 and slot 286 of frame 269 prevents moving portion 270 from rotating as threaded rod 281 rotates.

In this manner moving portion 270 can be caused to move from first end 282 to second end 284 of threaded rod 281.

Saw 200 can be attached to moving portion 270 and slidably connected to frame 269 via spaced apart tracks 280 and plurality of sliders/rollers 290, on which it can travel. Sliders/rollers 290 provide an interface between base 236 of saw 200 and tracks 280. The tracks 280 have a first end 280' and a second end 280', and saw can travel between the first 280' and second 280' ends.

In this manner saw 200 can be caused to move relative to frame 269 of generally horizontal extender and retractor 268, and also relative to elevator 400 to which extender and retractor 268 is attached.

Elevator 400

Figure 19:
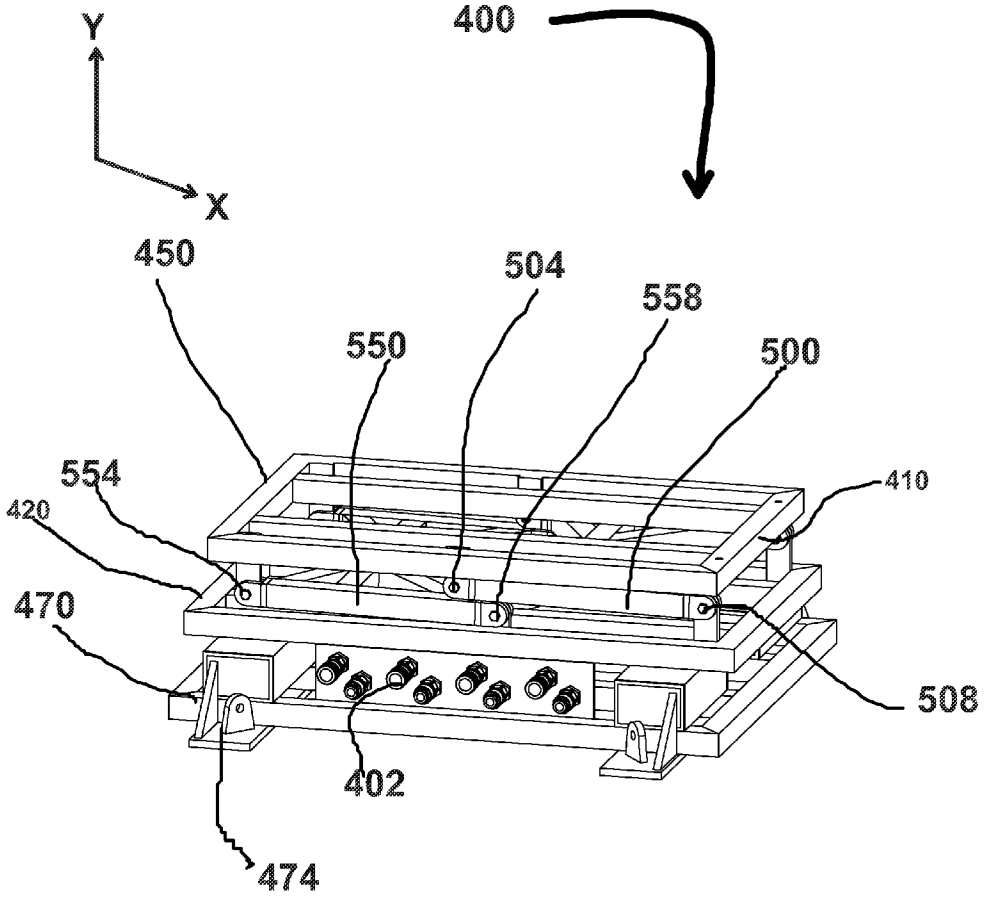
FIG. 19 is a side perspective view of the elevator (without cutter) of FIG. 3 shown in a completely lowered state.
Figure 20:
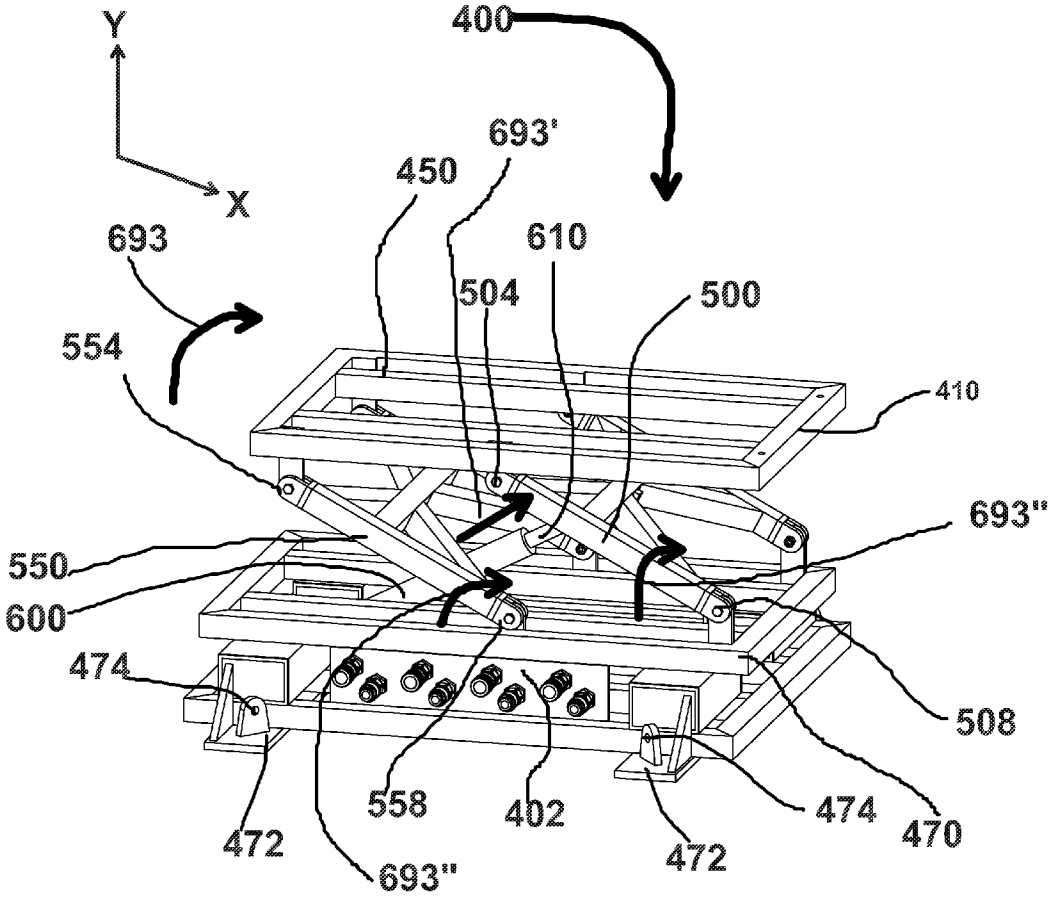
FIG. 20 is a side perspective view of the elevator (without cutter) of FIG. 3 shown in a partially raised state.
Figure 21:
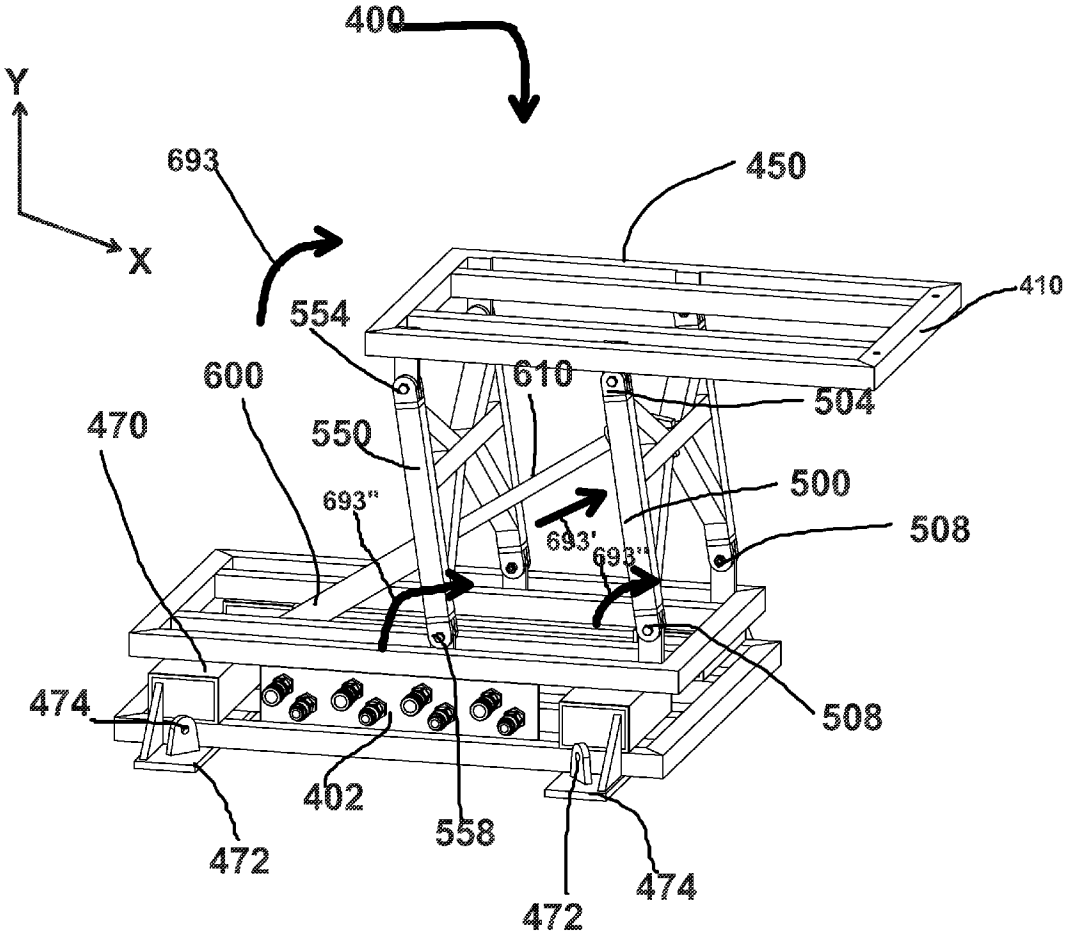
FIG. 21 is a side perspective view of the elevator (without cutter) of FIG. 3 shown in a fully raised state.
Figure 22:
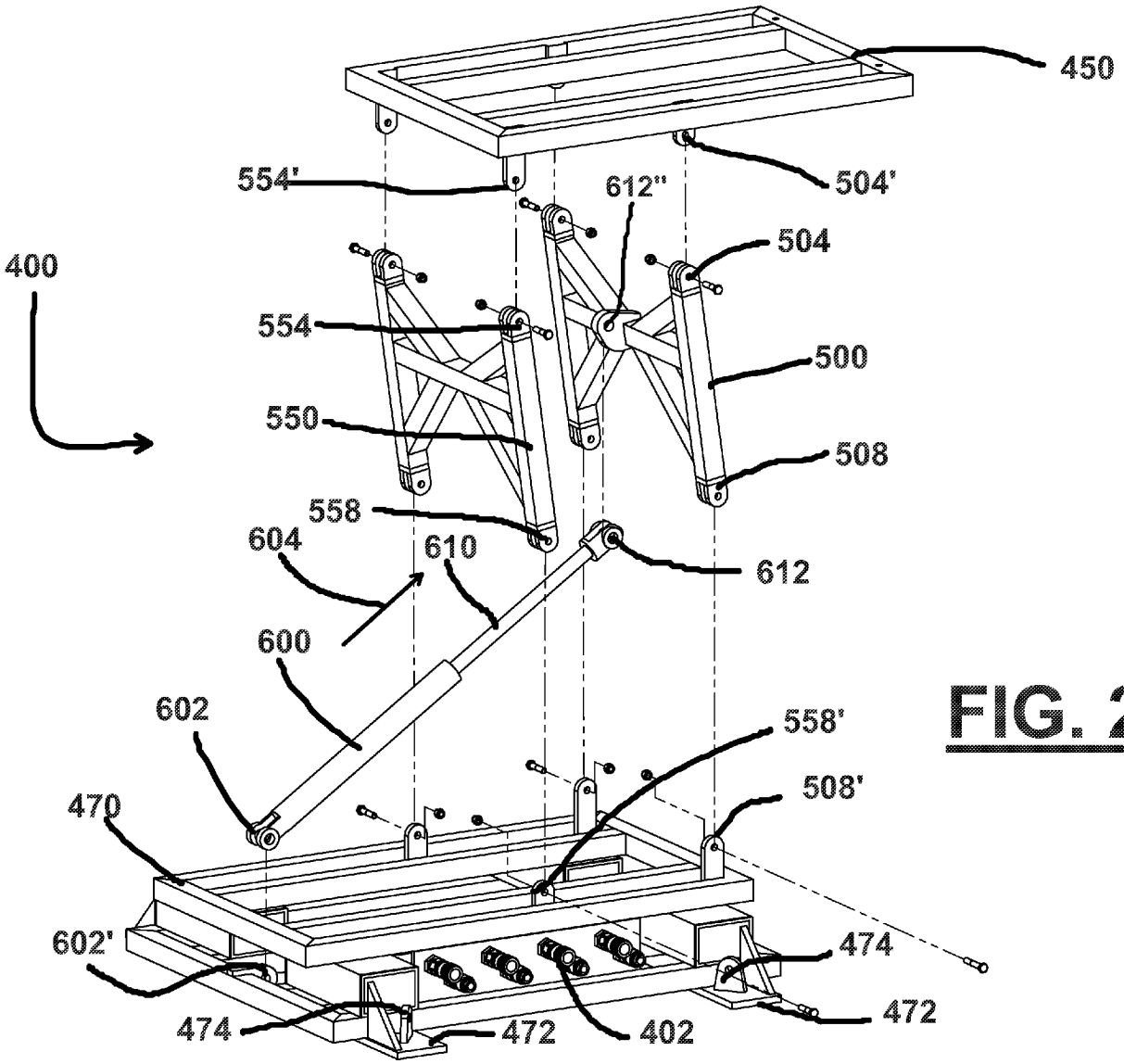
FIG. 22 is a perspective exploded view of the elevator taken from the side.
Figure 23:
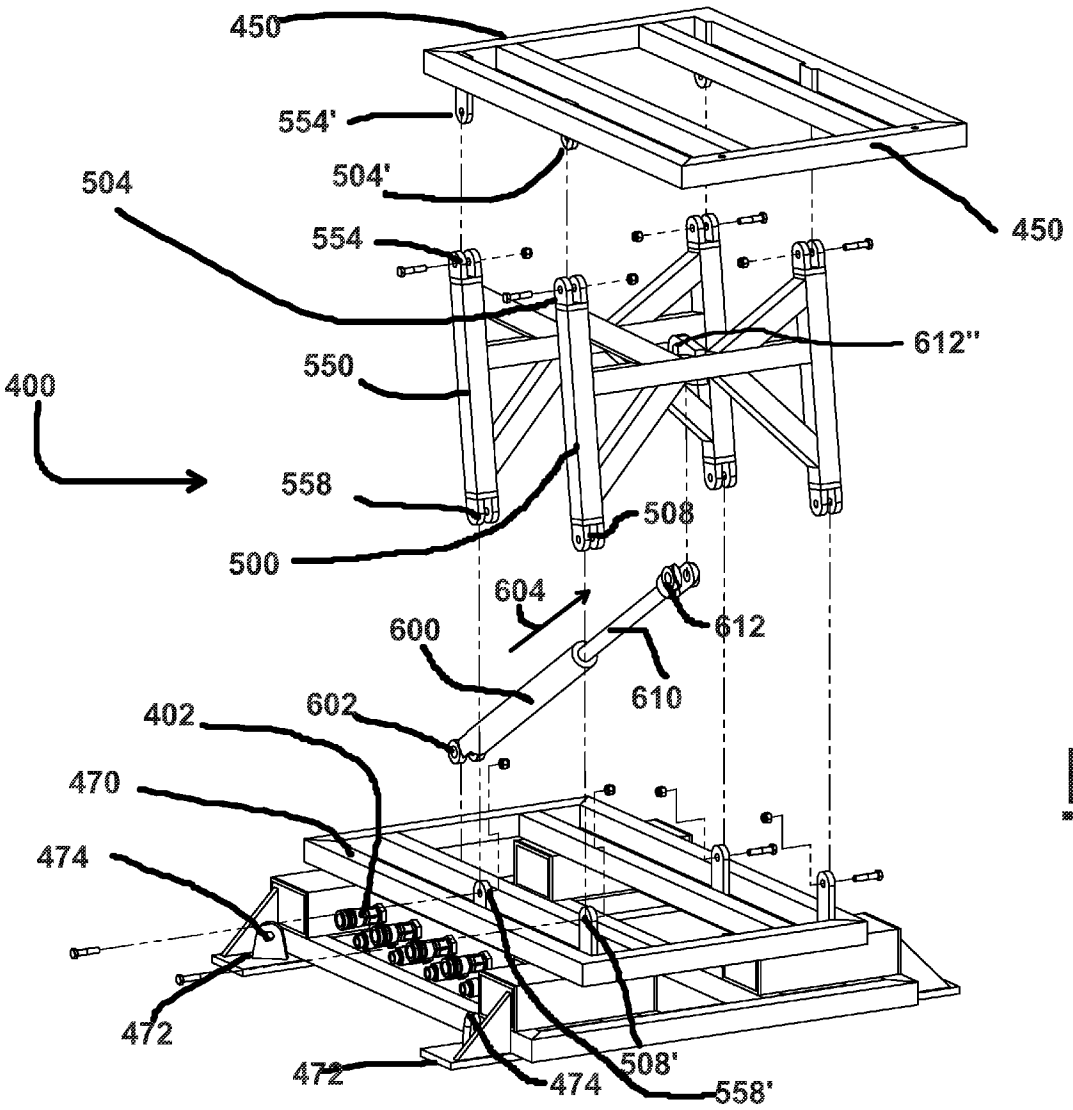
FIG. 23 is a perspective exploded view of the elevator taken from the front.

FIG. 19 is a side perspective view of the elevator 400 (without cutter 200) shown in a completely lowered state. FIG. 20 is a side perspective view of the elevator 400 (without cutter 200) shown in a partially raised state (schematically indicated by arrow 693). FIG. 21 is a side perspective view of the elevator 400 (without cutter 200) shown in a fully raised state (schematically indicated by arrow 693). FIG. 22 is a perspective exploded view of the elevator 400 taken from the side. FIG. 23 is a perspective exploded view of the elevator 400 taken from the front.

Elevator 400 generally comprises base 470, first pivoting support 500, second pivoting support 550, upper end portion 450, and hydraulic actuator 600. Elevator 400 has first end 410 and second end 420. Pivoting supports are provided including first pivoting support 500 and second pivoting support 550. Upper pivots 504 and lower pivot 508 can be seen in FIGS. 19-21. Also seen are upper pivot 554 and lower pivot 558.

FIG. 22 is an expanded or exploded view showing base 470, upper end portion 450, first pivoting support 500, second pivoting support 550, actuator 600, pushrod 610, pivot points 602, 612 and pivots 504, 554. In FIG. 22, arrow 604 designates extension of pushrod 610 relative to cylinder 600 when upper end portion 450 is to be both elevated and moved closer to pipe or tubular 900. Base 470 can have feet 472 with eyelets 474. Elevator assembly 400 includes hydraulic inputs 402 which are an interface between hoses to control panel 800 and the various components to be controlled (saw motor 250, feed motor, cylinder 600 and clamp 700).

First pivoting support 500 includes upper 504 and lower 508 pivot connections. Second pivoting support 550 includes upper 554 and lower 558 pivot connection. The distances between upper 504 and lower 508 pivoting connections for first pivoting support 500 is preferably equal to the distance between upper 554 and lower 558 pivoting connections for second pivoting support 550. Such equal distance will make the four bar system of base 470, first pivoting support 500, second pivoting support 550, and upper portion 450 a parallelogram thereby causing upper portion 450 to remain parallel to base 470 during pivoting of first 500 and second 550 pivoting supports.

As best shown in FIGS. 22 and 23, first 500 and second 550 pivoting supports are pivotally connected to both base 470 (pivot connection 508 connecting to connection 508; and pivot connection 558 connecting to connection 558') and upper end portion 450 (pivot connection 504 connecting to connection 504; and pivot connection 554 connecting to connection 554') forming a four bar system, preferably where upper end portion 450 remains generally parallel to base 470 during movement of upper end portion 450 relative to base 470.

Hydraulic actuator 600 includes arm 610 and first 602 and second 612 ends. Hydraulic actuator 600 is pivotally connected to base 470 (first end 602 connected at pivot connection 602') and one of the first 500 or second 550 pivoting supports (e.g., second end 612 connected at pivot connection 612').

FIGS. 19 through 21 respectively show lowered, middle, and elevated conditions of upper section 450 relative to base 470.

Hydraulic actuator 600 is operatively connected to controller 800 allowing controller 800 to control both extension and retraction of arm 610 relative to actuator 600. Extension of arm 610 (schematically indicated by arrow 693' in FIGS. 20 and 21) causes upper first 500 and second 550 pivoting supports to rotate relative to base (schematically indicated by arrow 693' in FIGS. 20 and 21), which rotation of said supports causes upper section 450 to both elevate in a vertical direction and move forward in a generally horizontal direction relative to base 470 (schematically indicated by arrow 693 in FIGS. 20 and 21).

In various embodiments, during elevation the amount of relative rotation by first 500 and second 550 pivoting members relative to base 470 and/or upper member 450 is at least 5 degrees. In various embodiments the amount of rotation is at least 5, 10, 15, 20, 25, 30, 35, 40, 45, 50, 55, 60, 65, 70, 75, 80, 85, 90, 100, 110, 120, 130, 140, 150, 160, 170, and 180 degrees. In various embodiments the amount of rotation during elevation is between a range of any two of the specified angular degree measurements. It is believed not preferable to have a greater than 90 degree relative rotation as said greater amount will cause upper member 450 to again start lowering relative to base 470 (although such greater amount of relative rotations do increase the amount of relative horizontal movement between upper portion and base 470, and may be necessary where, for various reasons on the rig, base 470 needs to be spaced farther apart from tubular 900 to be cut than typically envisioned). The relative extendable length of extension arm compared to the length of pivoting supports 500 and 550 will control the maximum amount of relative angular rotation between pivoting supports 500/550 and upper portion 450/base 470.

In an alternative embodiment a second elevator 400', constructed substantially the same as the first elevator 400, could be connected to upper portion 450 of first elevator 400 (with both elevators being operatively connected to controller 800 via their respectively hydraulic members 600 and 600'), with generally horizontal extender and retractor 268 being connected to upper portion 450' of second elevator 400'. In this manner the vertical raising of saw 200 using elevator 400' could be added to any vertical raising obtained by elevator 400 by operator 810 operating controller 800.

In another alternative embodiment, generally horizontal extender and retractor 268 can be omitted, having saw connected to upper portion 450, and using the horizontal movement component of upper portion 450 to cut into tubular 900. However, this embodiment is not preferred as with the horizontal movement of upper portion 450 there would also be at least some vertical movement which vertical movement would tend to, during a cut of tubular 900, impose a vertical force on saw blade 240, and said vertical force tending to cause saw blade 240 to bind, seize, and/or fail during the cut. Generally horizontal extender and retractor 268 allows only horizontal movement of blade 240 relative to tubular 900 to be cut minimizing the chance of causing saw blade 240 to bind, seize, and/or fail during a cut.

Clamp 700

In FIGS. 24-39 there can be seen hydraulic clamp 700. Clamp 700 grips pipe or tubular 900 when it is being cut by saw blade 240 (see FIGS. 12, 13). FIGS. 28-39 provide various views of clamp 700, which can be attached to frame 269 of generally horizontal extender and retractor 268. Alternatively, clamp 700 can be attached to elevator 400 directly (such as being attached to upper portion 450 of elevator 400).

Clamp 700 comprises a pair of pivoting arms 740, each of which are operatively connected to a hydraulic cylinder 750. Controller 800 is operatively connected to each hydraulic cylinder 750.

Figure 37:
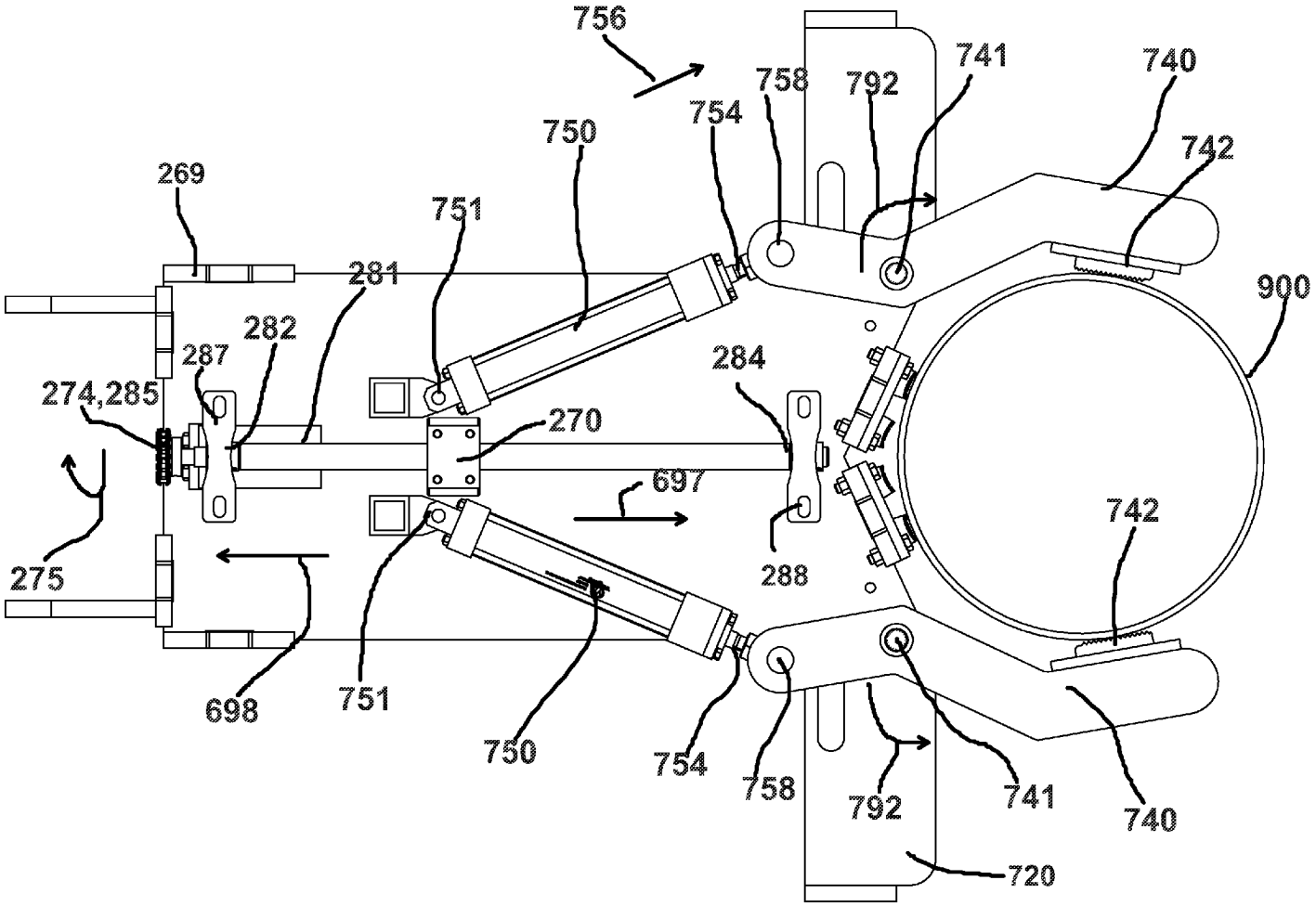
FIG. 37 is a top view of the clamp showing the clamping jaws closed on a tubular to be cut, wherein the tubular to be cut is larger than the tubular shown in FIG. 36.
Figure 38:
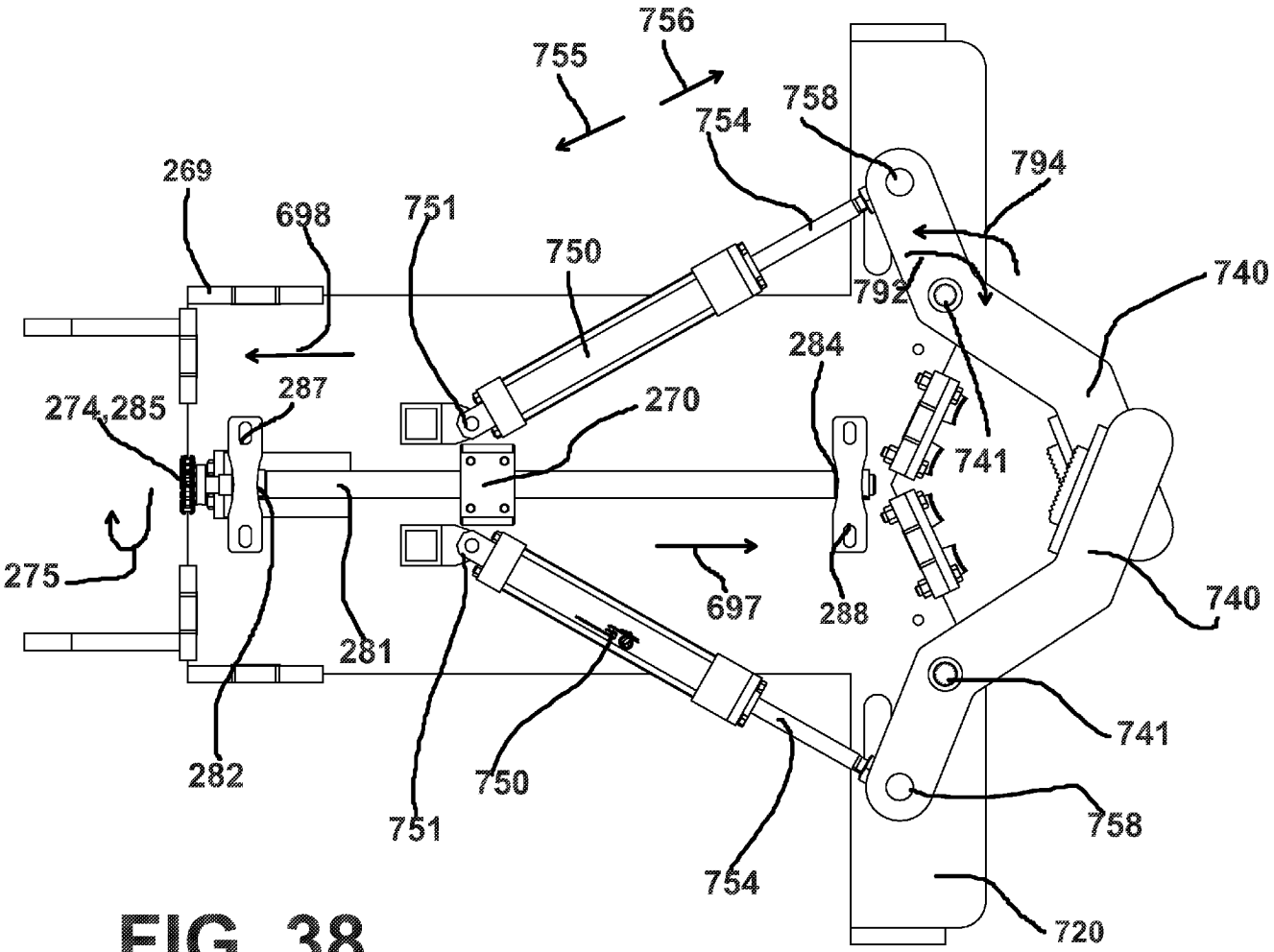
FIG. 38 is a top view of the clamp showing the clamping jaws partially closed (with no tubular shown).
Figure 39:
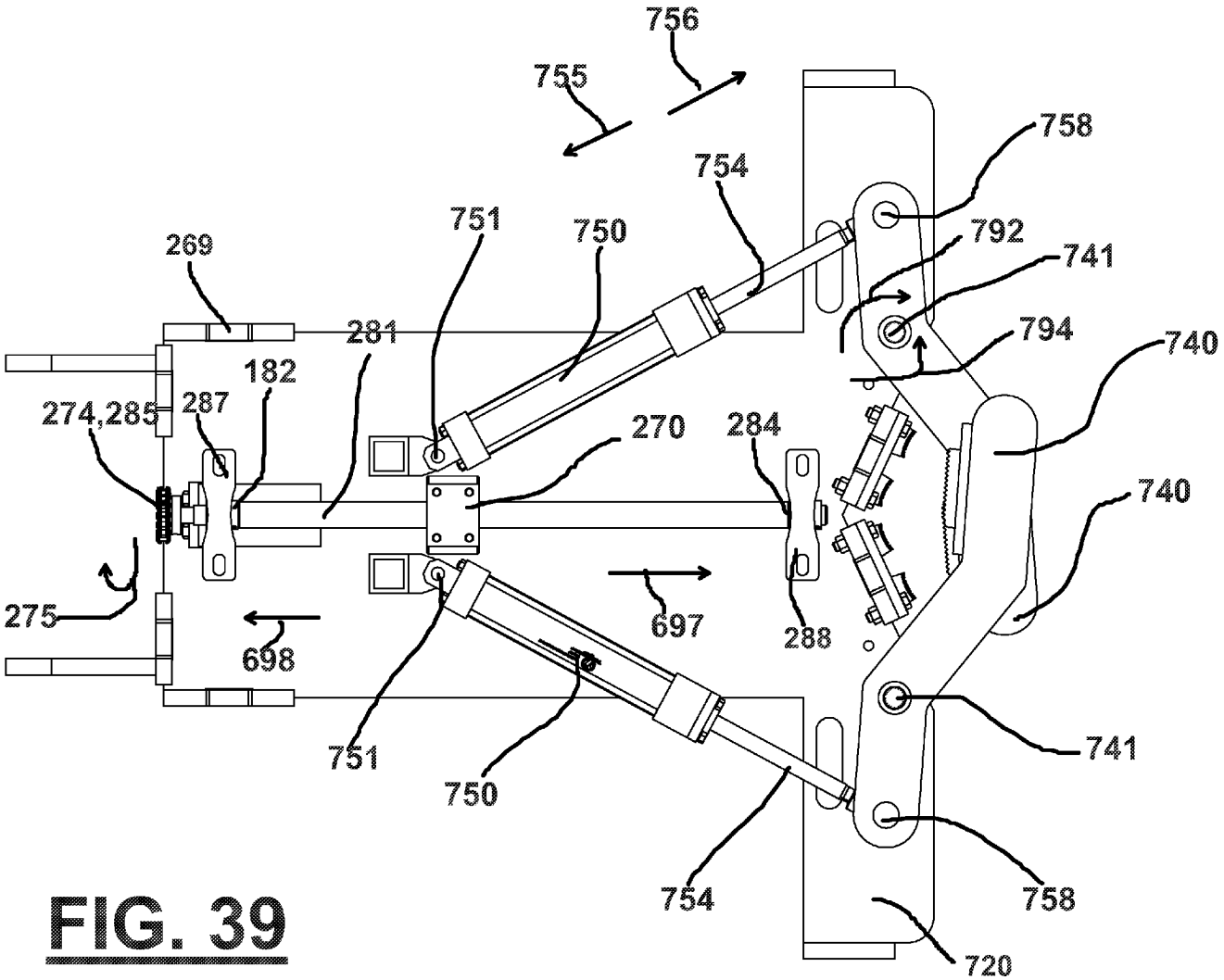
FIG. 39 is a top view of the clamp showing the clamping jaws fully closed (with no tubular shown).

In one embodiment, clamp apparatus 700 is below saw blade 240. Pinned connection 758 connects pushrod 754 to pivoting arms 740 (see FIG. 27). In one embodiment, one cylinder 750 and pushrod 754 operates or moves two arms 740 (see FIG. 27). In FIG. 37-39 there can be seen two cylinders 750 and pushrods 754 that operate all arms 740.

FIGS. 36 through 39 best show the clamping and unclamping operations of clamp 700. Clamp apparatus 700 has body 720, hinge 730 and opposed pivoting arms 740 with friction inserts 744 (FIGS. 22 and 36-39). Body 720 can be attached to (and/or incorporated within frame 269 of generally horizontal extender and retractor 268. Friction inserts 742 can also be provided at 742 on upper end portion 450.

Cylinder 750 and pushrod 754 can power arms 740 to move between an open position (FIG. 22) and a closed position (FIGS. 12, 36, and 37) wherein the clamp apparatus 700 grips the pipe or tubing 900. The operation of cylinders 750 and power arms 740 are best shown in FIGS. 36-39. Each cylinder can include a hydraulic extension arm/rod 754. Each cylinder 750 at one of its ends can be pivotally connected to a power arm 740 at a pivot joint 758. Each cylinder 750 at the opposing of its end can also be pivotally connected to body 720 at a pivot joint 751.

As each cylinder 750 causes hydraulic extension arm/rod 754 to extend (schematically indicated by arrow 756), such extension causes power arm 740 to rotate (schematically indicated by arrow 792) about pivot joint 741. On the other hand, as each cylinder 750 causes hydraulic extension arm/rod 754 to retract (schematically indicated by arrow 755), such retraction causes power arm 740 to rotate in the opposite direction (schematically indicated by arrow 794) about pivot joint 741. In this manner, power arms 740 can be caused to clamp/close or open on an object such as tubular 900 to be held in place while a cut is made.

Figure 29:
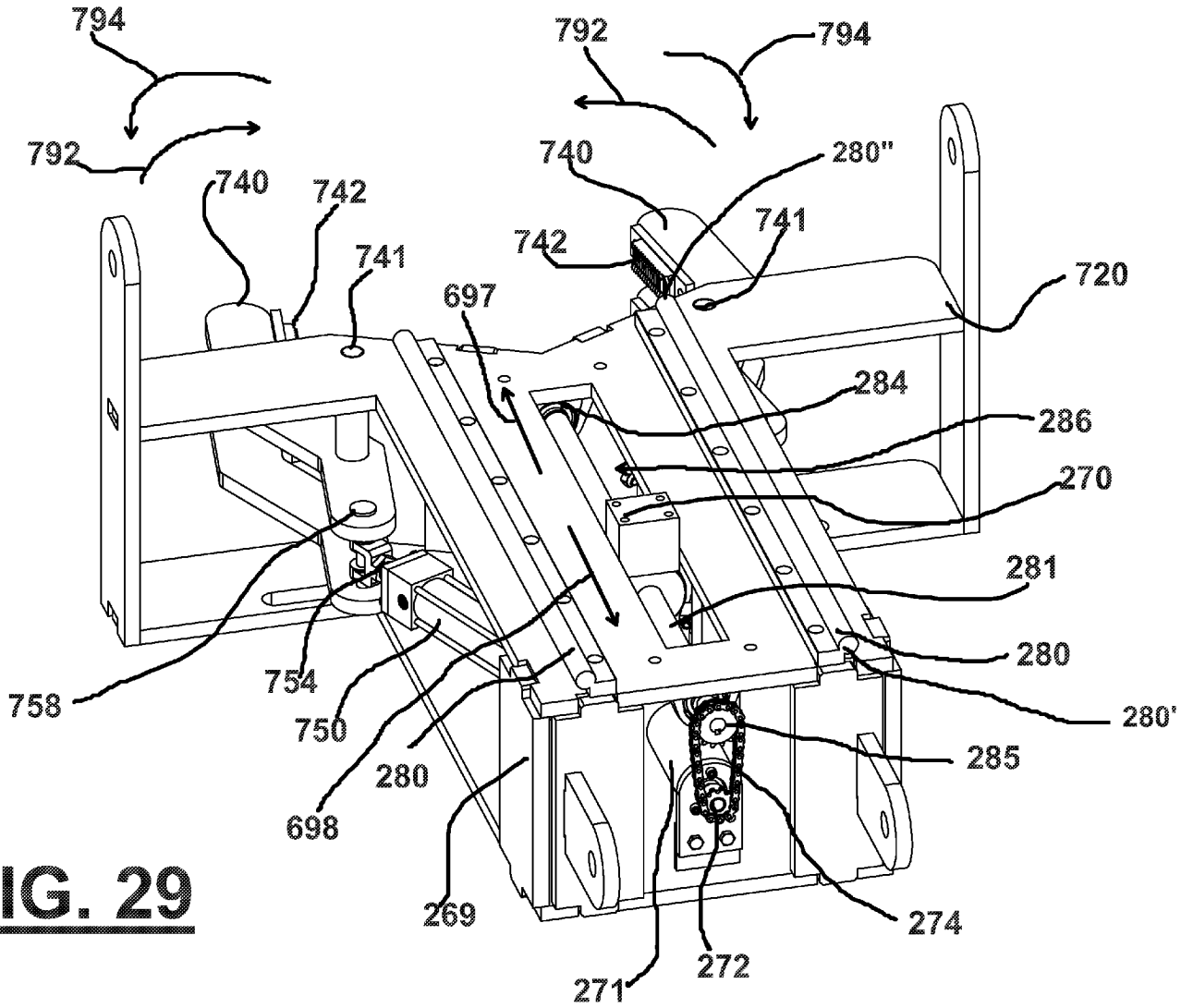
FIG. 29 is a perspective view of the clamp taken from the rear.
Figure 30:
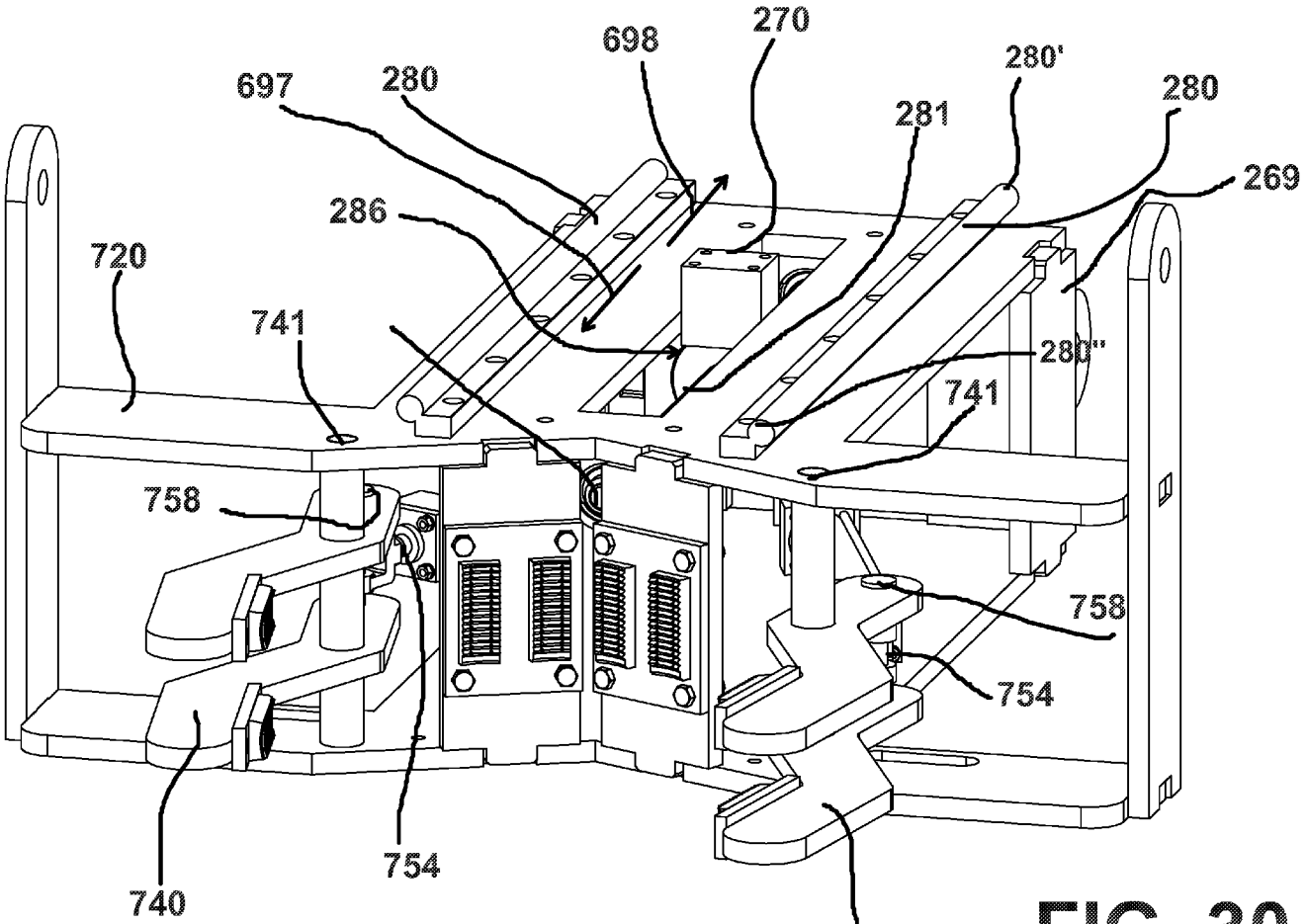
FIG. 30 is a perspective view of the clamp taken from the front showing the clamping jaws open.
Figure 31:
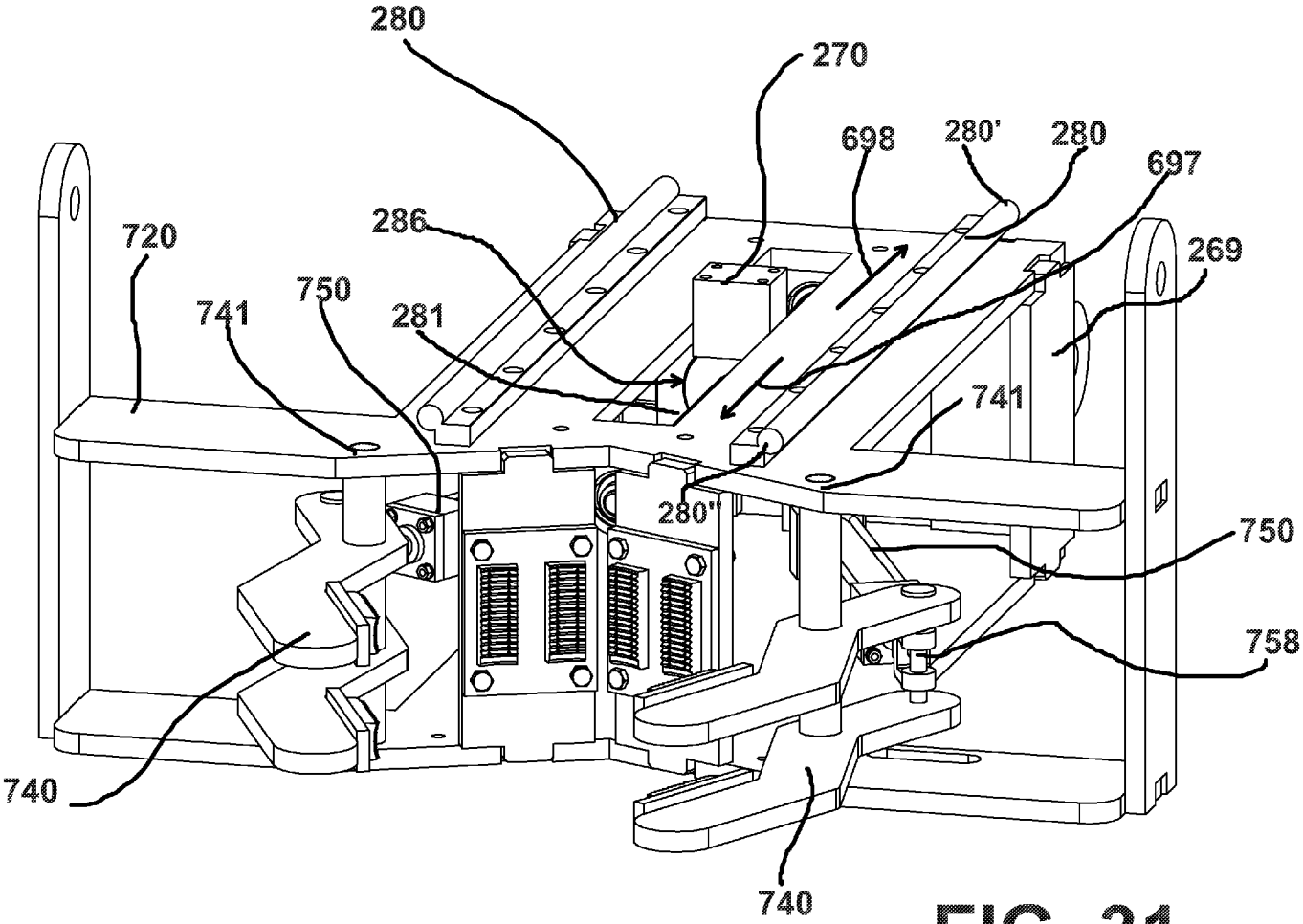
FIG. 31 is a perspective view of the clamp taken from the front showing the clamping jaws partially closed.
Figure 32:
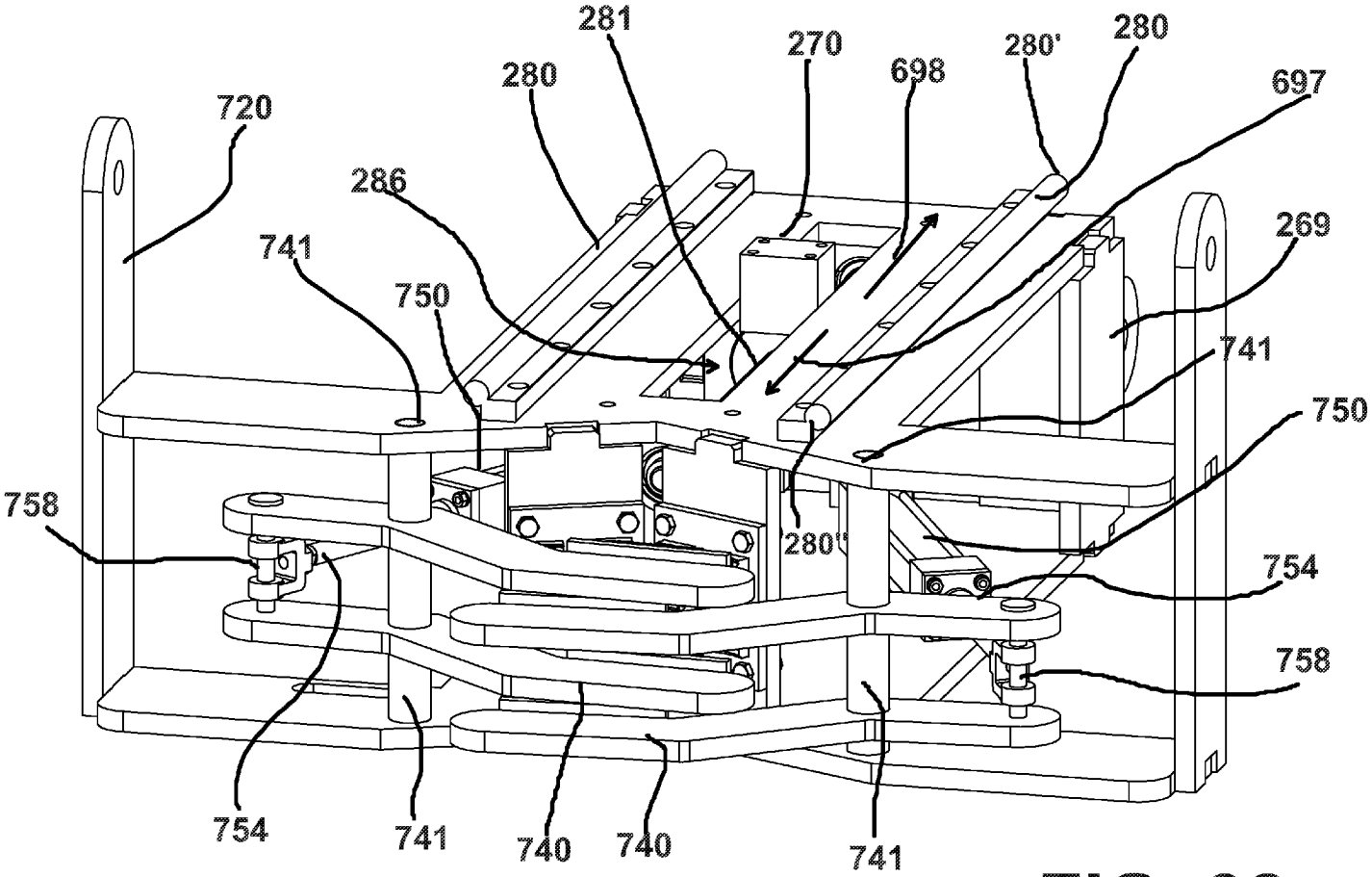
FIG. 32 is a perspective view of the clamp taken from the front showing the clamping jaws fully closed.
Figure 33:
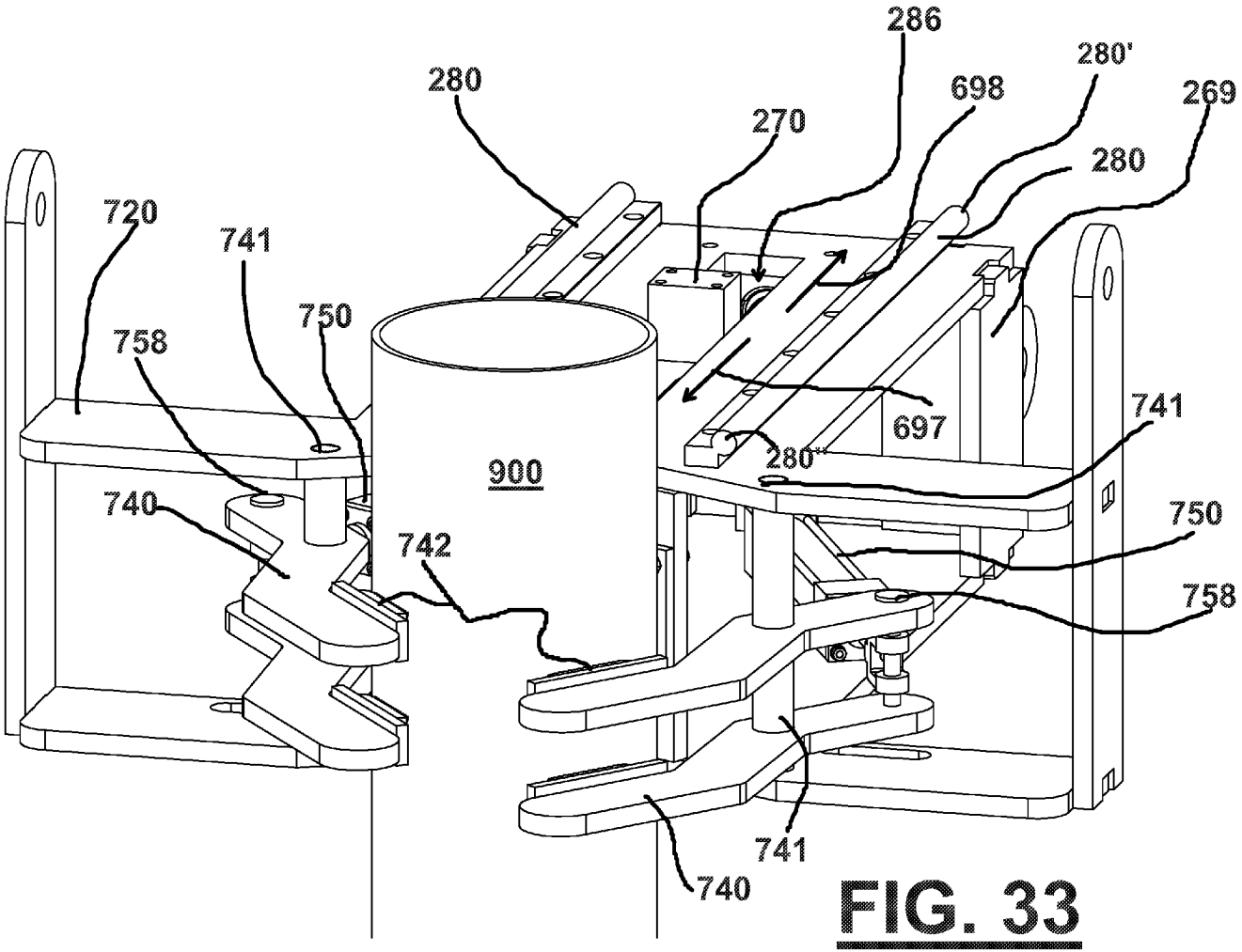
FIG. 33 is a perspective view of the clamp taken from the front showing the clamping jaws closed on a tubular to be cut.
Figure 34:
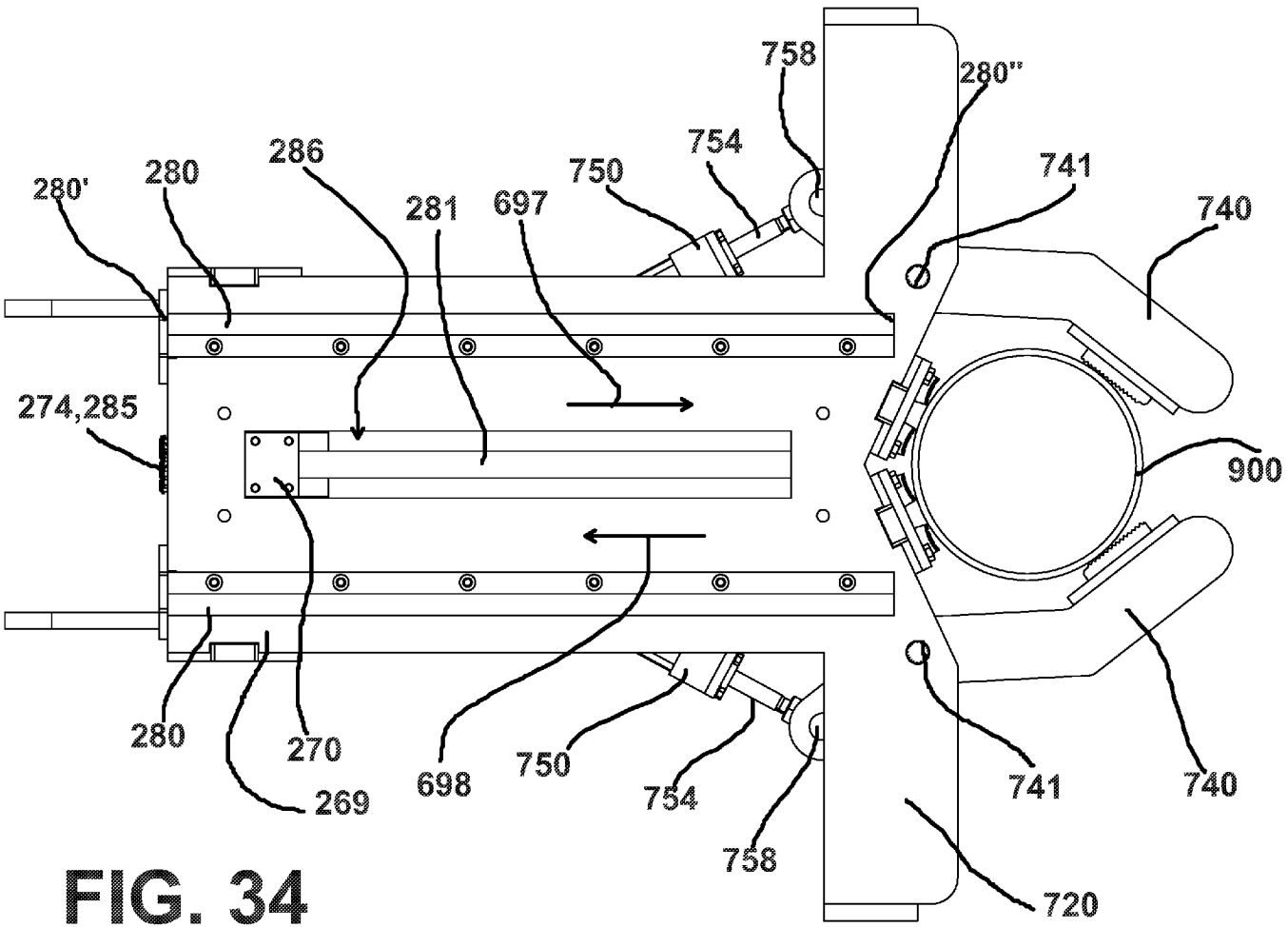
FIG. 34 is a top view of the clamp attached to a tubular to be cut with the movable cutter base completely retracted.

FIG. 28 is a perspective view of the cutter 200 and clamp 700 taken from the front. FIG. 29 is a perspective view of the clamp 700 taken from the rear. FIG. 30 is a perspective view of the clamp 700 taken from the front showing the clamping jaws 740 open. FIG. 31 is a perspective view of the clamp 700 taken from the front showing the clamping jaws 740 partially closed. FIG. 32 is a perspective view of the clamp 700 taken from the front showing the clamping jaws 740 fully closed. FIG. 33 is a perspective view of the clamp 700 taken from the front showing the clamping jaws 740 closed on a tubular 900 to be cut. FIG. 34 is a top view of the clamp 700 attached to a tubular 900 to be cut with the movable cutter base 270 completely retracted (schematically indicated by arrow 698).

Figure 35:
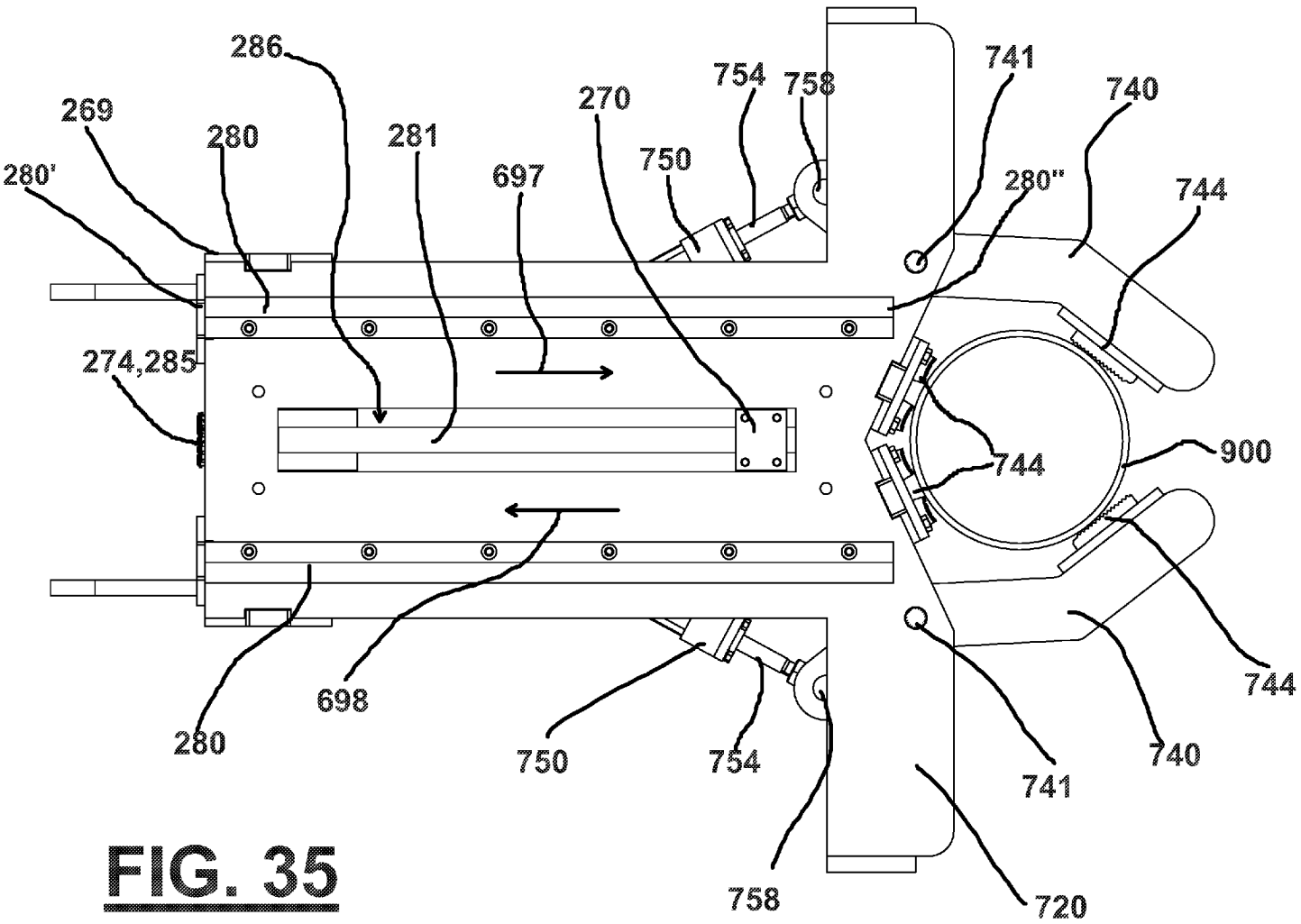
FIG. 35 is a top view of the clamp attached to a tubular to be cut with the movable cutter base completely extended.

FIG. 35 is a top view of the clamp 700 attached to a tubular 900 to be cut with the movable cutter base 270 completely extended (schematically indicated by arrow 697).

Figure 36:
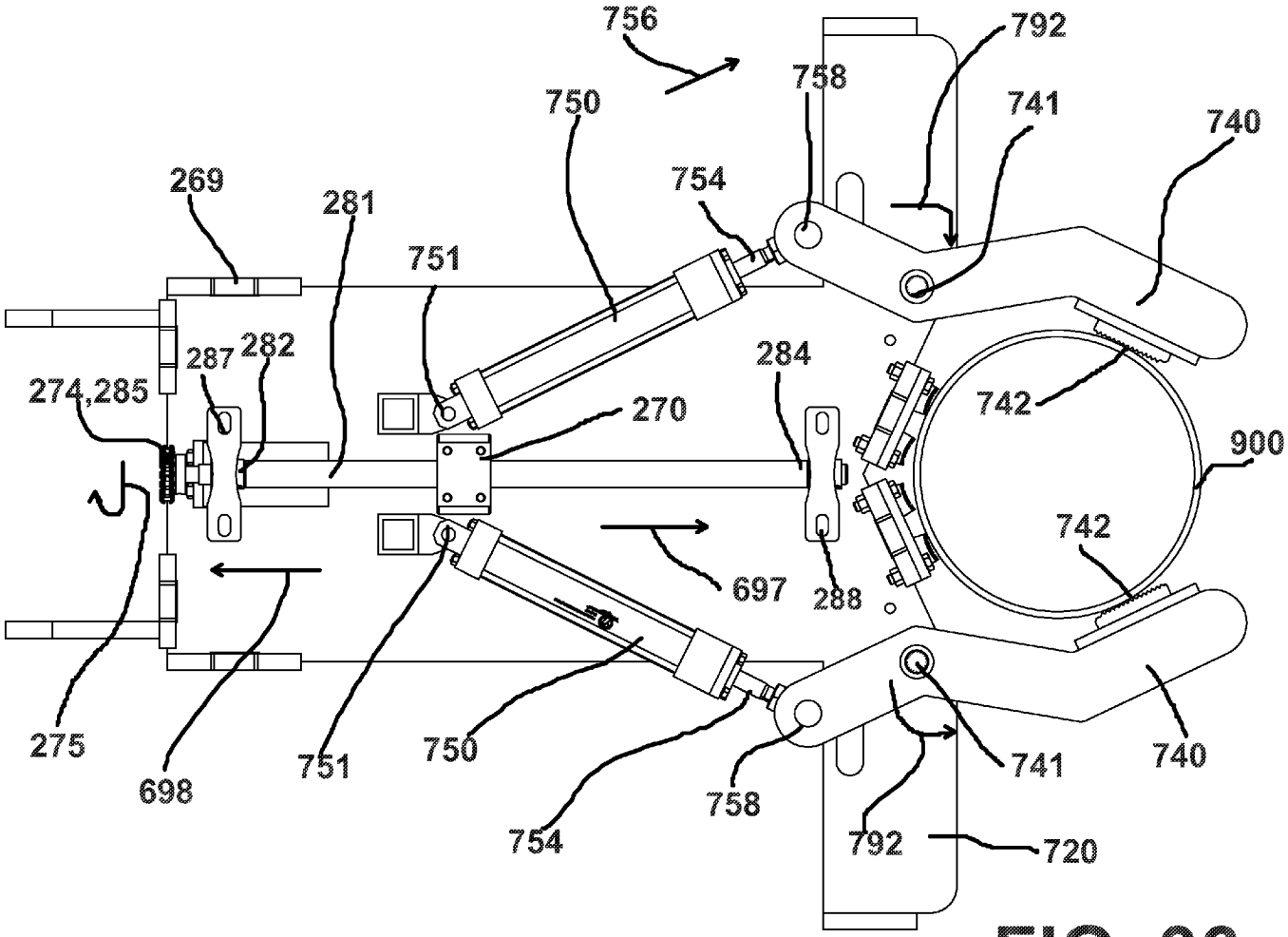
FIG. 36 is a top view of the clamp showing the clamping jaws closed on a tubular to be cut.

FIG. 36 is a top view of the clamp 700 showing the clamping jaws 740 closed on a tubular 900 to be cut. FIG. 37 is a top view of the clamp 700 showing the clamping jaws 740 closed on a tubular 900 to be cut, wherein the tubular 900 to be cut is larger than the tubular 900 shown in FIG. 36. FIG. 38 is a top view of the clamp 700 showing the clamping jaws 740 partially closed (with no tubular shown). FIG. 39 is a top view of the clamp 700 showing the clamping jaws 740 fully closed (with no tubular shown).

Controller 800

Controller 800 comprises controls/levers 820 and instruments 830. Control panel 800 enables an operator to control motor drive 250, feed motor, cylinder 300 and clamp 700. Hydraulic lines 278 are provided for supplying hydraulic fluid. Hydraulic fluid is supplied via hydraulic hoses to the motor drive 250, feed motor, hydraulic cylinder 300, and clamp 700. If not provided by rig a hydraulic power supply 850 can be provided to power the method and apparatus.

The general method using the apparatus 10 will be generally described below.

General Method

Raising and Making a Cut

Figure 4:
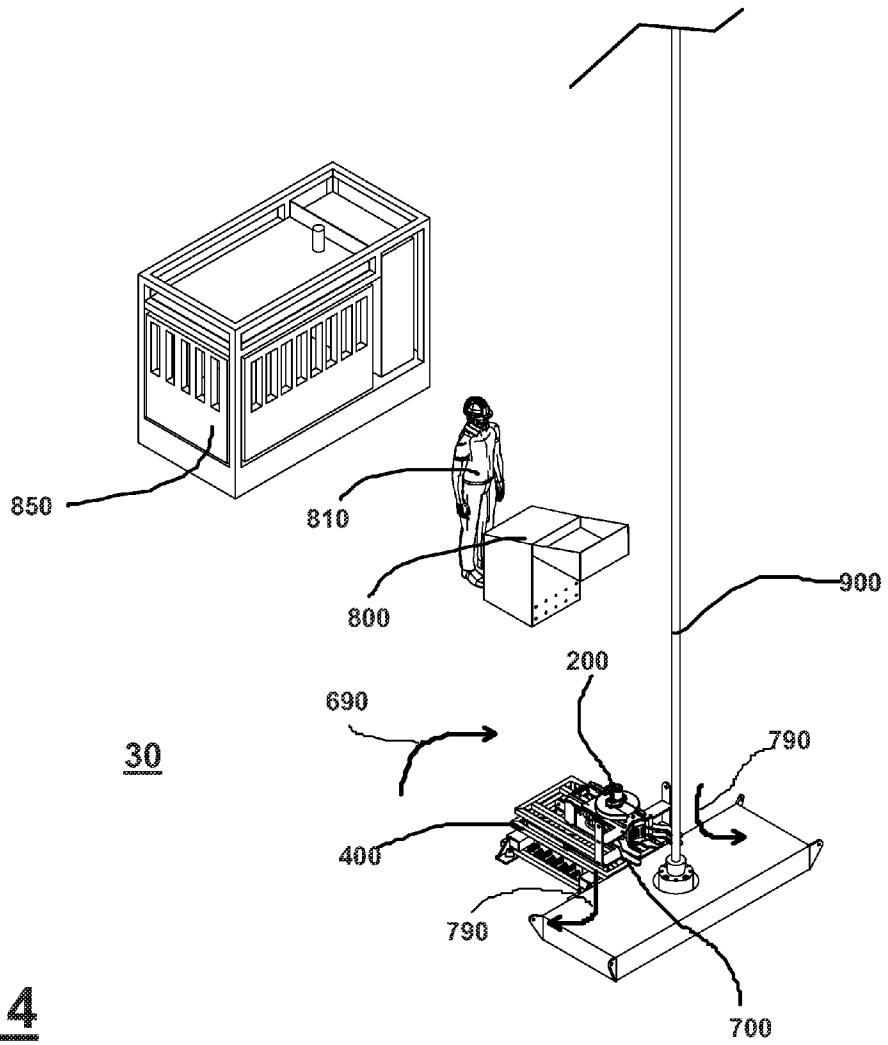
FIG. 4 is an overall perspective view of the elevator and cutter of FIG. 3 shown in a retracted and partially raised state, with the clamp arms opened.
Figure 5:
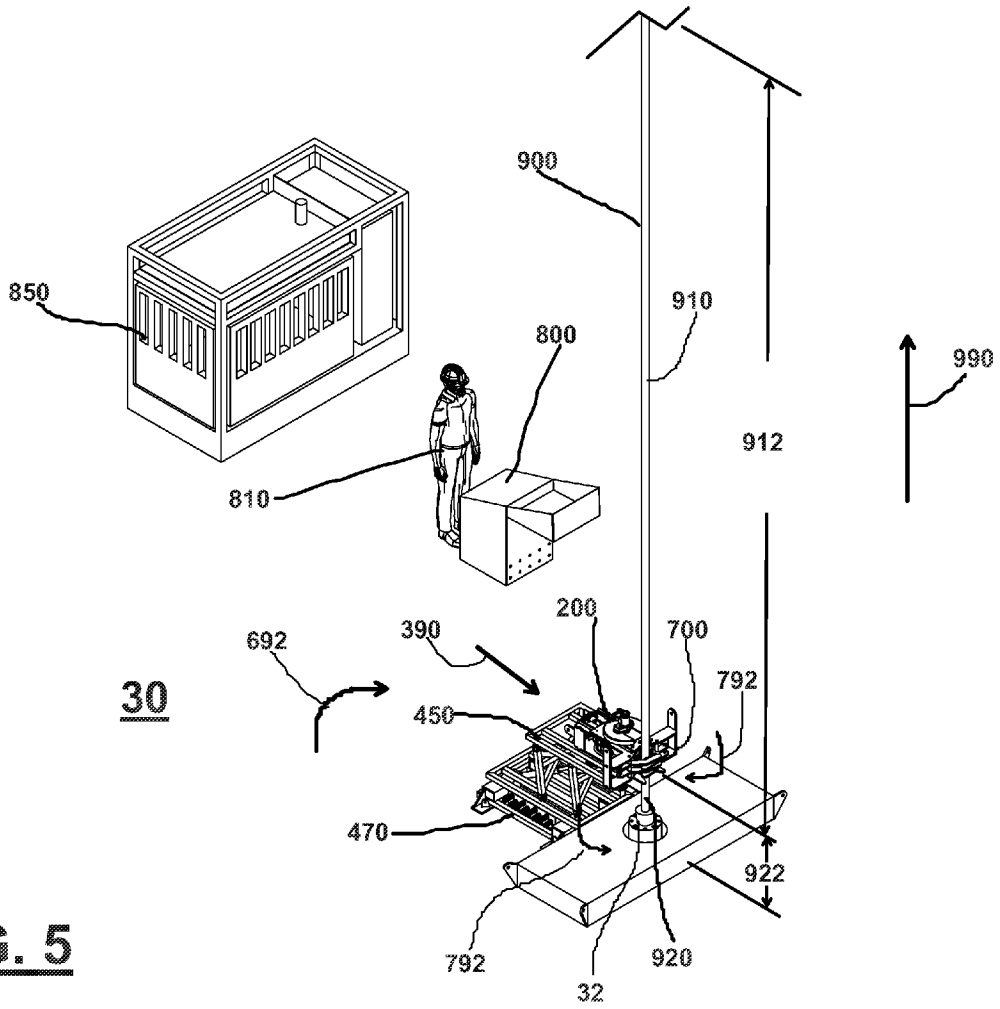
FIG. 5 is an overall perspective view of the elevator and cutter of FIG. 3 shown in a retracted and fully raised state, with the clamp arms closed around a vertical string of joints of tubulars.
Figure 6:
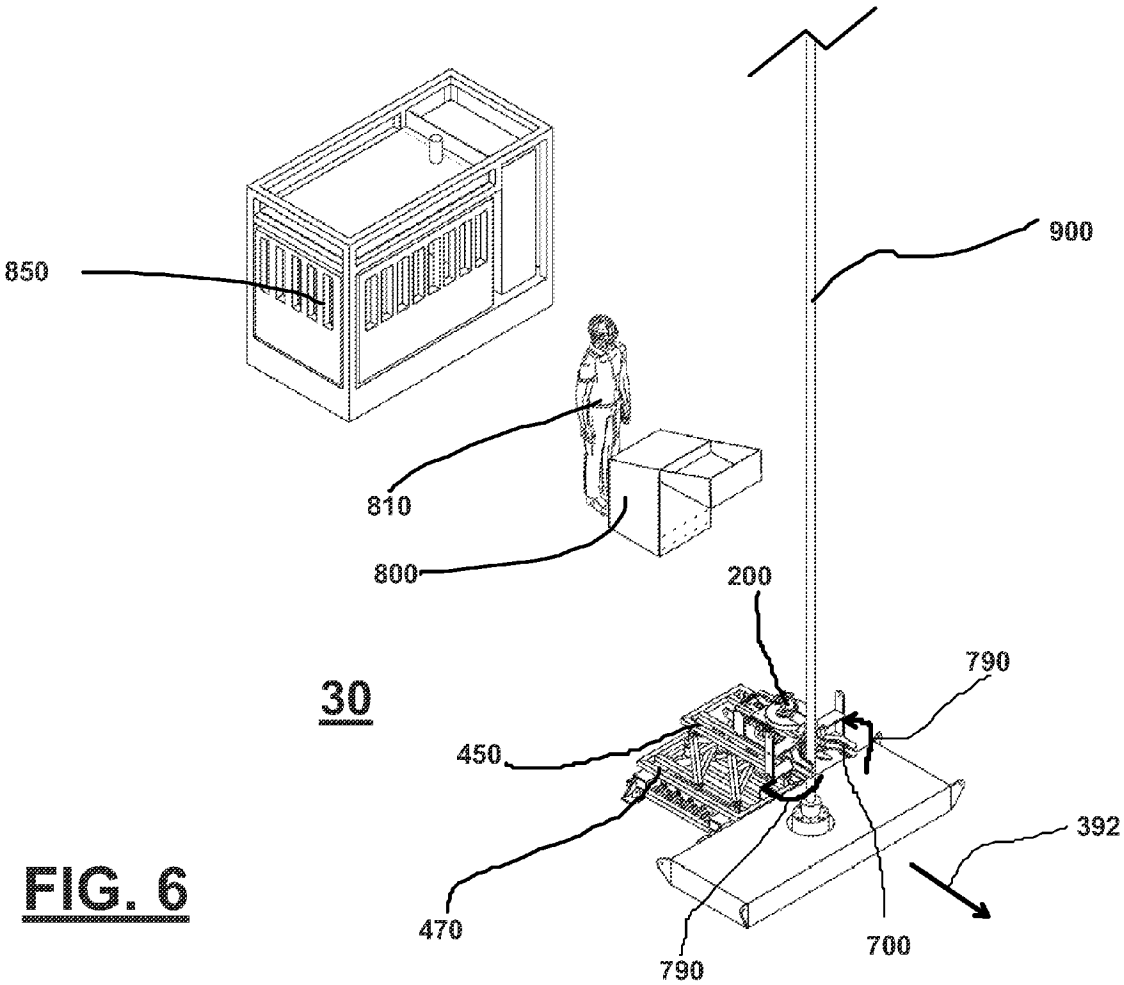

FIG. 3 is an overall perspective view of one embodiment of the elevator and cutter 10 shown in a retracted and lowered state. FIG. 4 is an overall perspective view of the elevator and cutter 10 shown in a retracted and partially raised state (schematically indicated by arrow 690), with the clamp 700 arms opened (schematically indicated by arrows 790). FIG. 5 is an overall perspective view of the elevator and cutter 10 shown in a retracted and fully raised state (schematically indicated by arrow 692), with the clamp 700 arms closed around (schematically indicated by arrows 792) a vertical string of joints of tubulars 900, and the saw 200 moving horizontally towards tubular 900 to make a cut (schematically indicated by arrow 390). FIG. 6 is an overall perspective view of the elevator and cutter 10 shown in an extended and fully raised state and having made a cut in the string of tubulars 900, with the clamp 700 arms now opened (schematically indicated by arrows 790) to allow the higher joint to be removed and disposed of. FIG. 7 is an overall perspective view of the elevator and cutter 10 shown in an extended and fully raised state and having made a cut in the string of tubulars 900, with the cut joint 910 being removed and disposed of.

Figure 8:
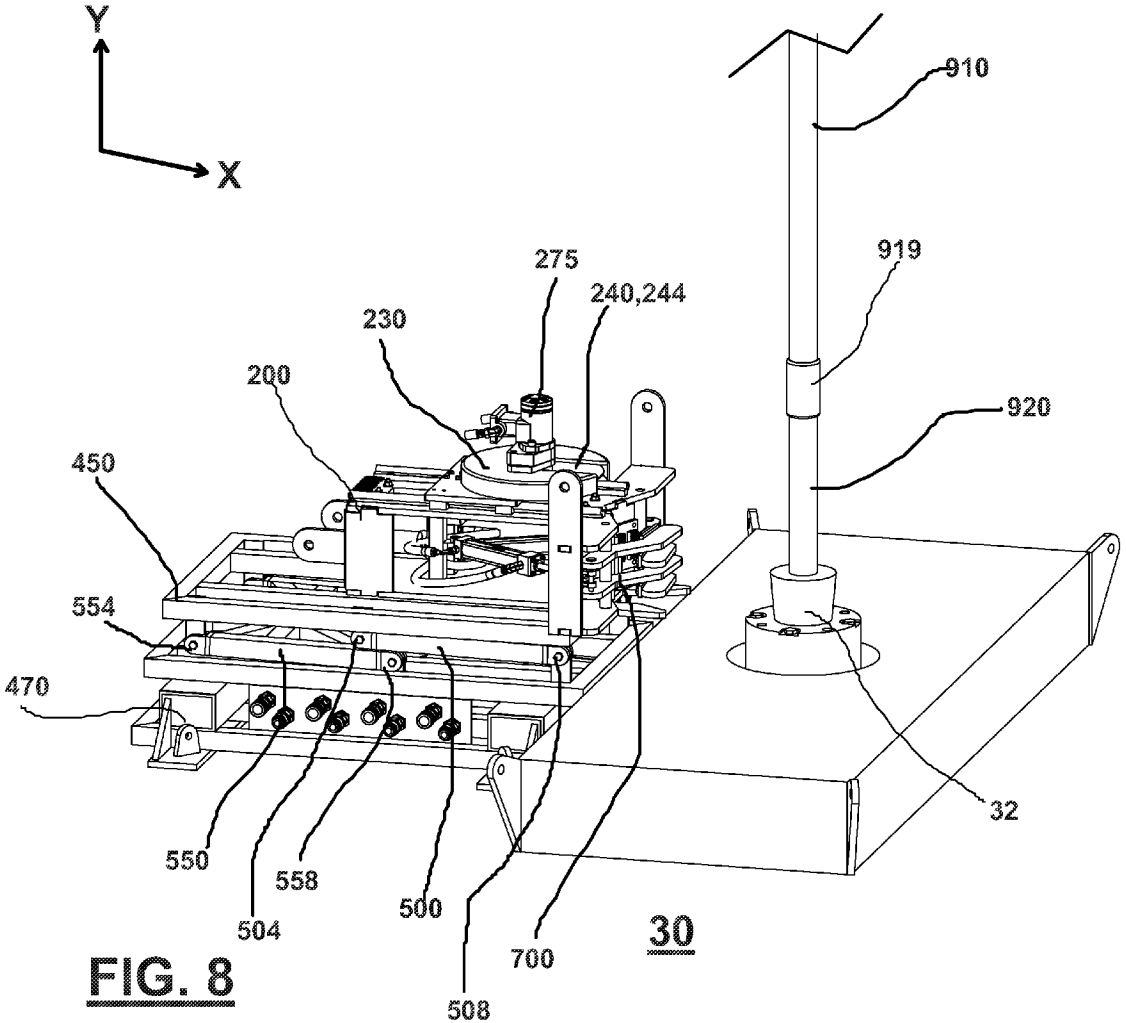
FIG. 8 is a side perspective view of the elevator and cutter of FIG. 3 shown in a retracted and fully lowered state, with the clamp arms closed.
Figure 9:
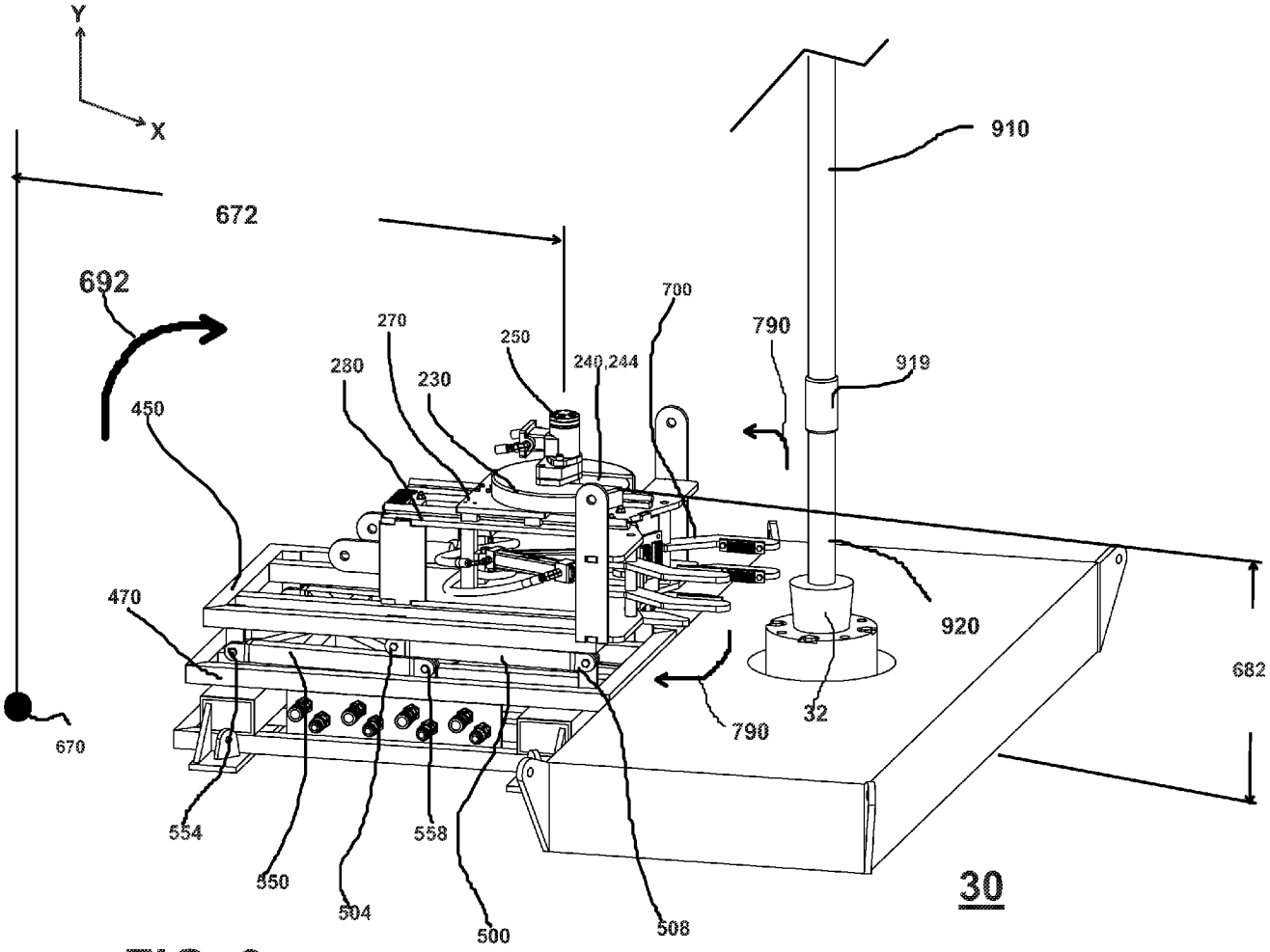
FIG. 9 is a side perspective of the elevator and cutter of FIG. 3 shown in a retracted and fully lowered state, with the clamp arms now opened.
Figure 10:
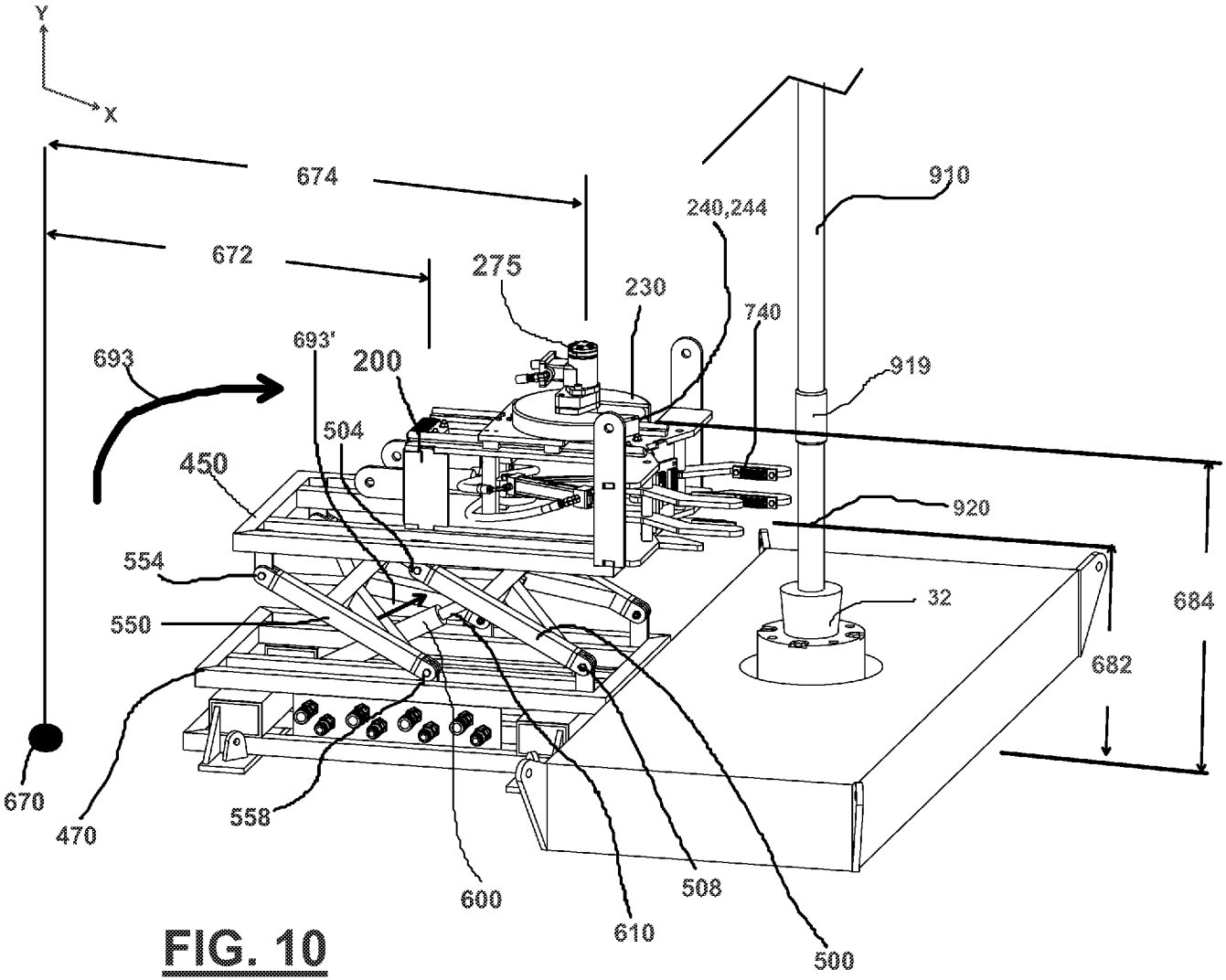
FIG. 10 is a side perspective view of the elevator and cutter of FIG. 3 shown in a retracted and partially raised state, with the clamp arms opened.
Figure 11:
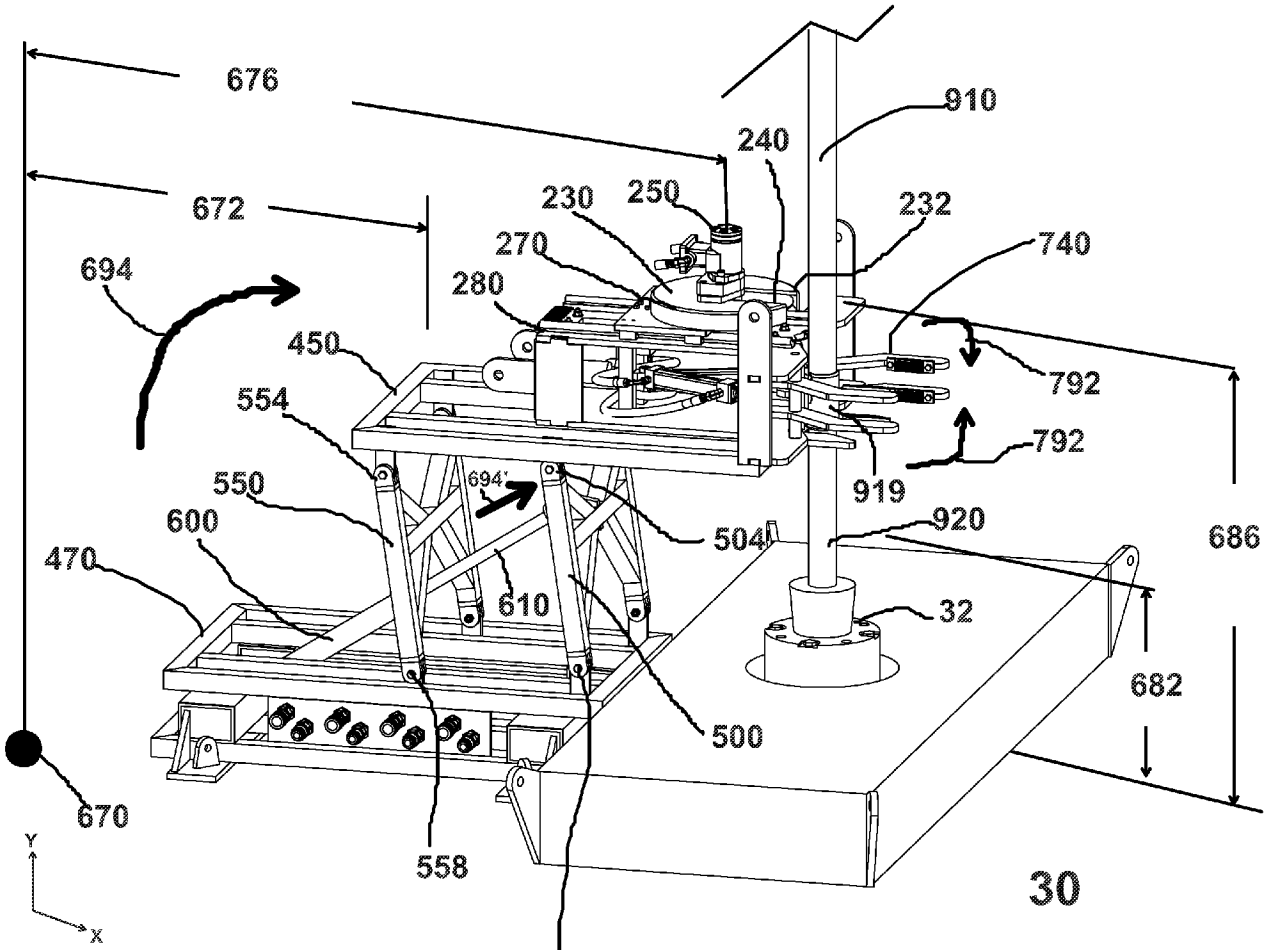
FIG. 11 is a side perspective view of the elevator and cutter of FIG. 3 shown in a retracted and fully raised state, with the clamp arms open around a vertical string of joints of tubulars to be cut.
Figure 12:
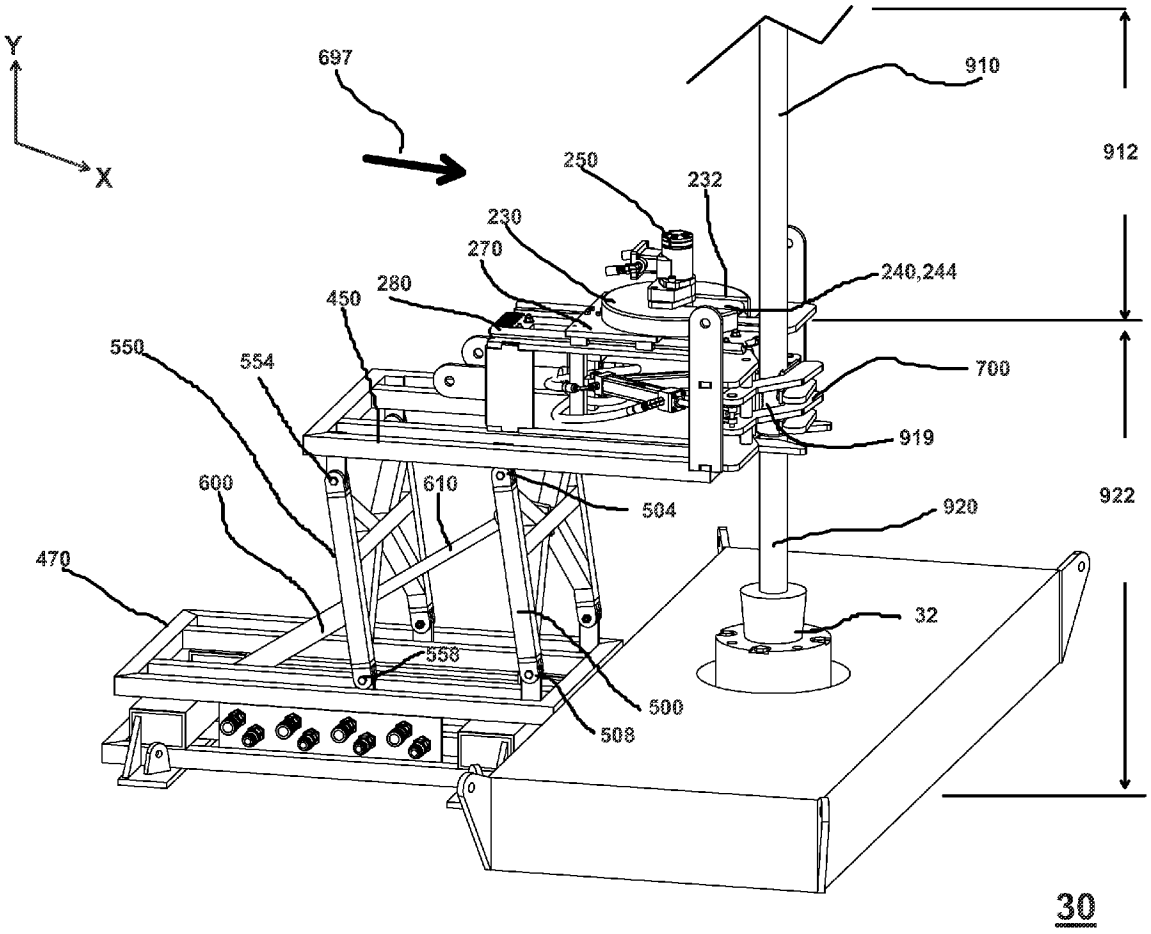
FIG. 12 is a side perspective view of the elevator and cutter of FIG. 3 shown in a retracted and fully raised state, with the clamp arms closed around a vertical string of joints of tubulars to be cut.
Figure 13:
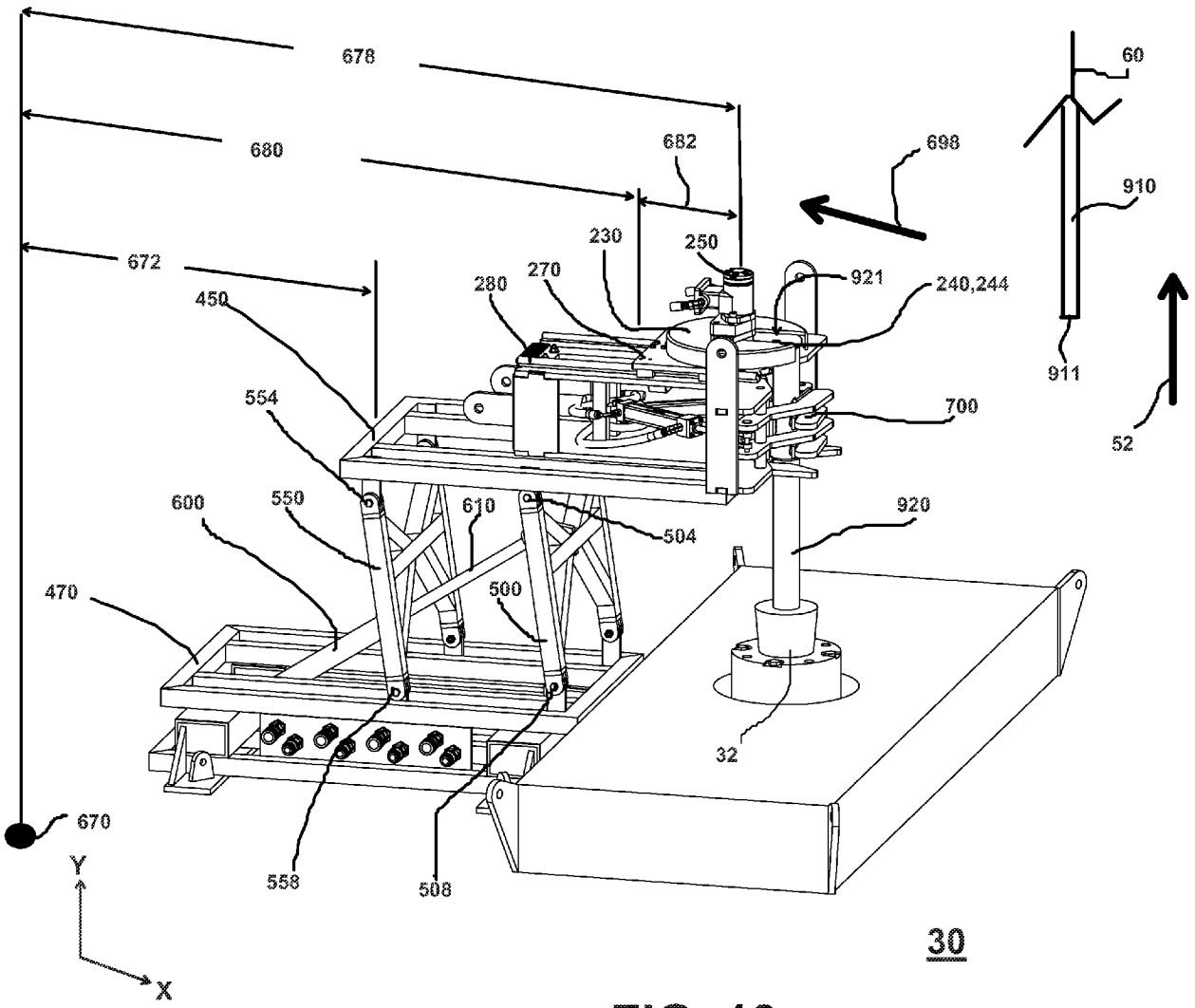
FIG. 13 is a side perspective view of the elevator and cutter of FIG. 3 shown in an extended and fully raised state, with the clamp arms closed on a vertical string of joints of tubulars now cut, and showing the upper joint of the string being removed for disposal after having been cut.
Figure 14:
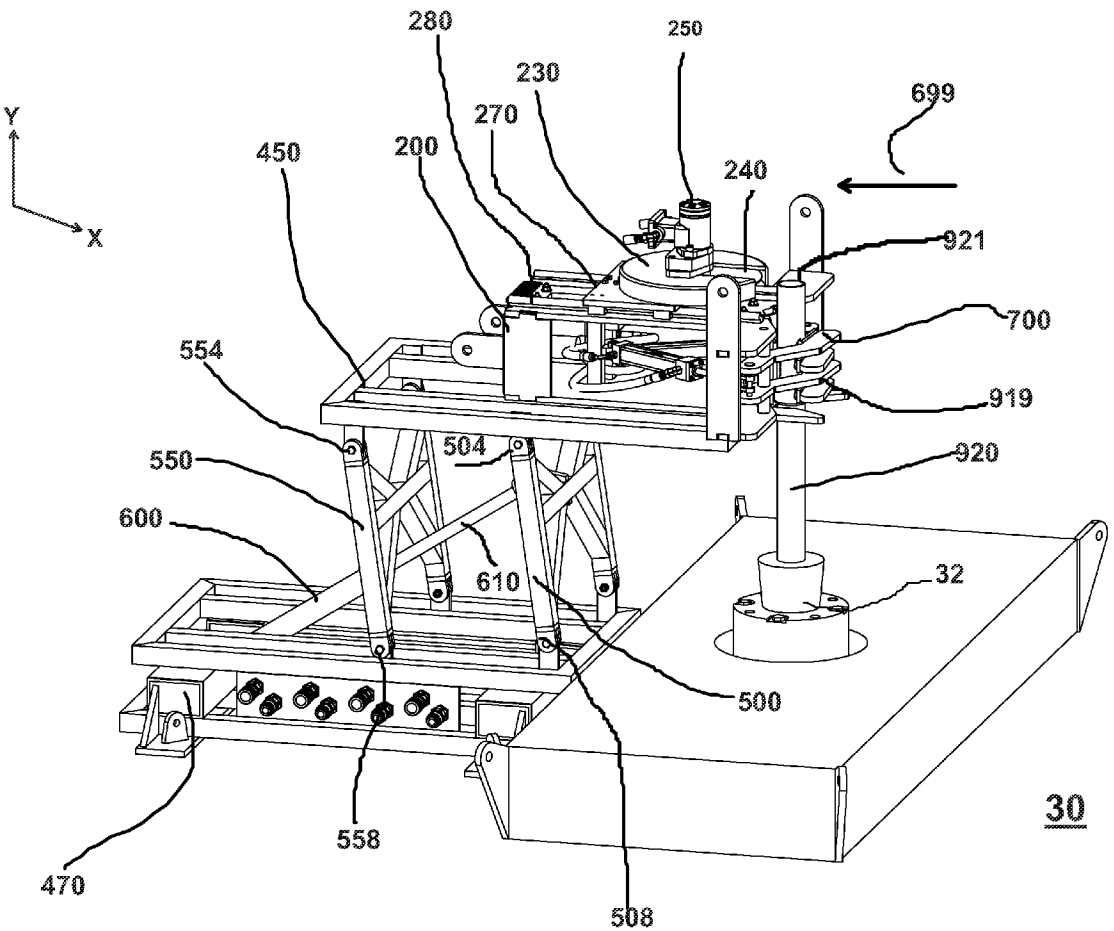
FIG. 14 is a side perspective view of the elevator and cutter of FIG. 3 shown in a retracted and fully raised state, with the clamp arms closed around a vertical string of joints of tubulars already cut, and with the upper joint removed after having been cut.

FIG. 8 is a side perspective view of the elevator and cutter 10 shown in a retracted and fully lowered state, with the clamp 700 arms closed. FIG. 9 is a side perspective of the elevator and cutter 10 shown in a retracted and fully lowered state, with the clamp 700 arms now opened (schematically indicated by arrows 790). FIG. 10 is a side perspective view of the elevator and cutter 10 shown in a retracted and partially raised state (schematically indicated by arrow 693), with the clamp 700 arms opened. FIG. 11 is a side perspective view of the elevator and cutter 11 shown in a retracted and fully raised state (schematically indicated by arrow 694), with the clamp 700 arms open around a vertical string of joints of tubulars 900 to be cut. FIG. 12 is a side perspective view of the elevator and cutter 10 shown in a retracted and fully raised state, with the clamp 700 arms closed around a vertical string of joints of tubulars 900 to be cut. FIG. 13 is a side perspective view of the elevator and cutter 10 shown in an extended and fully raised state, with the clamp 700 arms closed on a vertical string of joints of tubulars now cut, and showing the upper joint 910 of the string 900 being removed for disposal after having been cut (schematically indicated by arrow 52). FIG. 14 is a side perspective view of the elevator and cutter 10 shown in a retracted and fully raised state, with the clamp 700 arms closed around a vertical string of joints of tubulars already cut 920, and with the upper joint removed after having been cut.

Repositioning after a Cut

Figure 15:
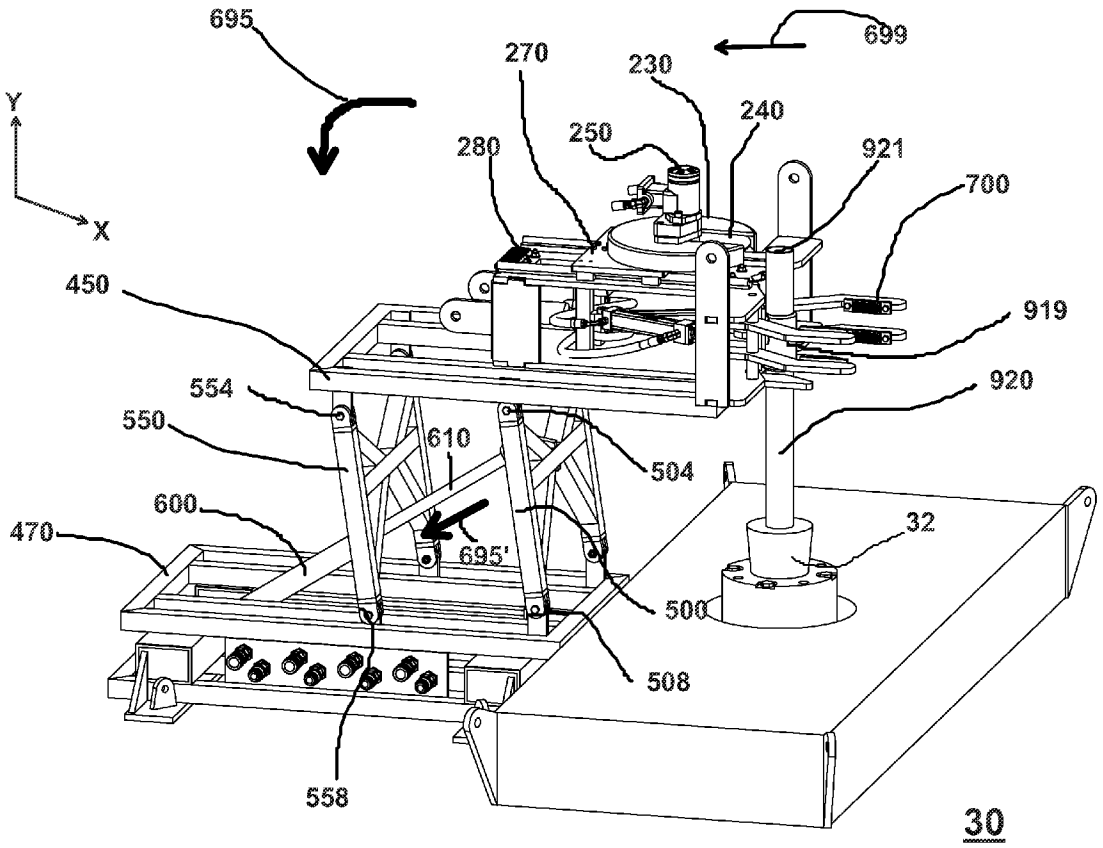
FIG. 15 is a side perspective view of the elevator and cutter of FIG. 3 shown in a retracted and fully raised state, with the clamp arms opened now opened.
Figure 16:
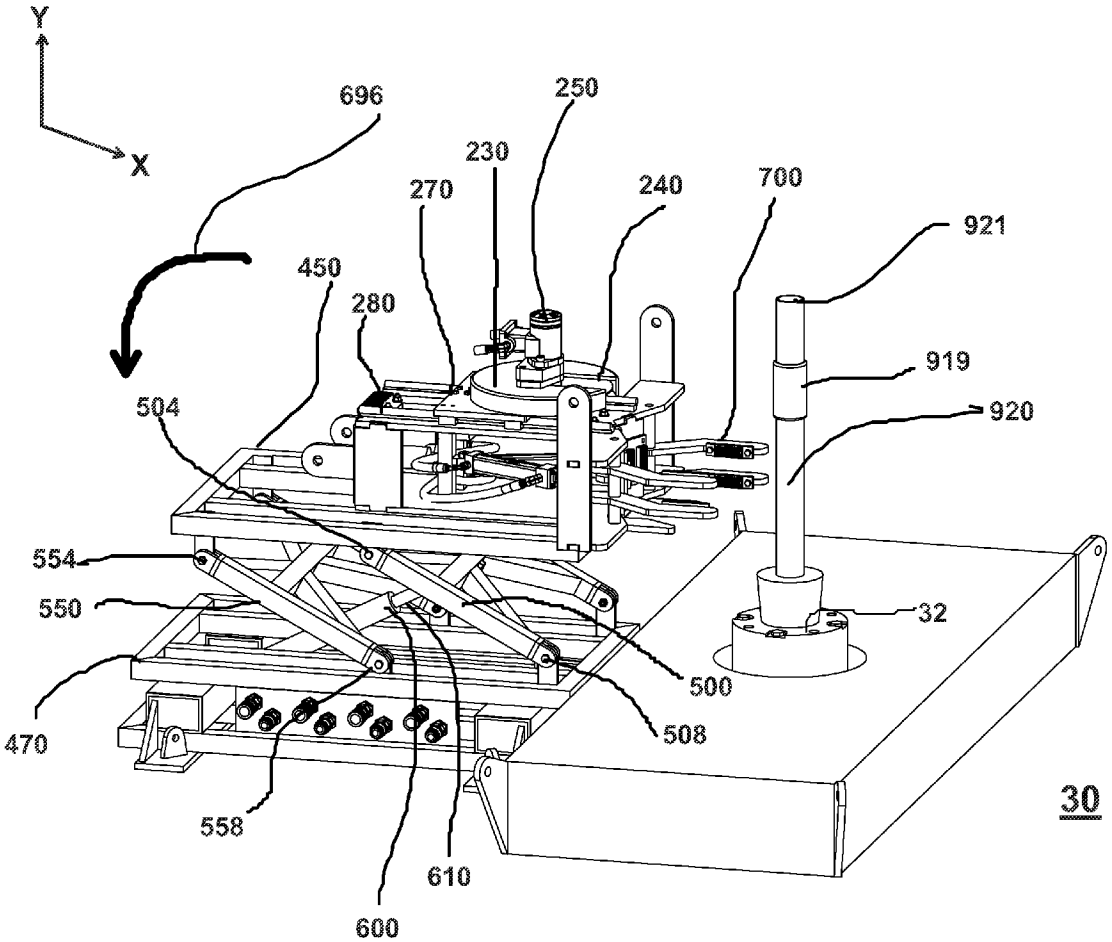
FIG. 16 is a side perspective view of the elevator and cutter of FIG. 3 shown being lowered with the clamp arms opened remaining opened.
Figure 17:
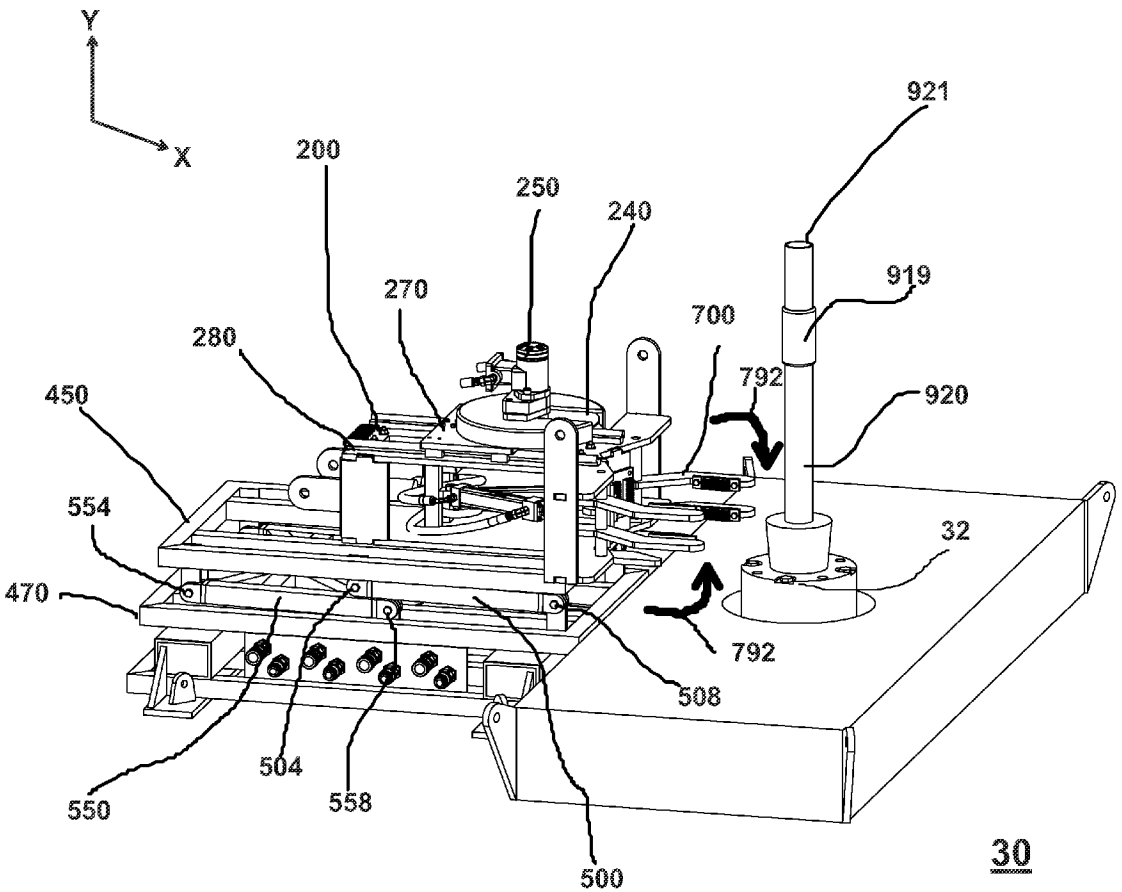
FIG. 17 is a side perspective view of the elevator and cutter of FIG. 3 shown now completely lowered with the clamp arms opened remaining opened.
Figure 18:
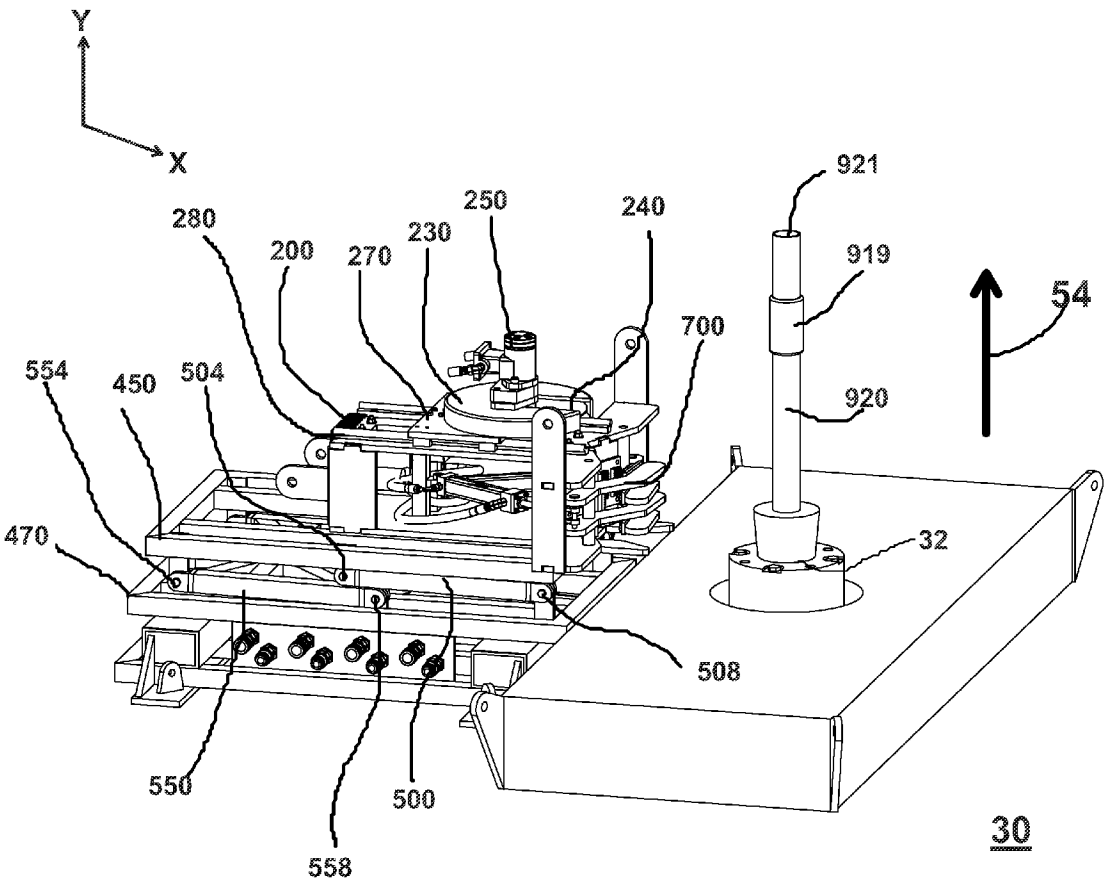
FIG. 18 is a side perspective view of the elevator and cutter of FIG. 3 shown now completely lowered with the clamp arms now closed, and schematically indicating that the remaining string of tubulars will be raised for another cut by the cutter.

FIG. 15 is a side perspective view of the elevator and cutter 10 shown in a retracted and fully raised state, with the clamp 700 arms opened now opened. FIG. 16 is a side perspective view of the elevator and cutter 10 shown being lowered (schematically indicated by arrow 696) with the clamp 70 arms remaining opened during the lowering. Alternatively, the clamp arms 740 can be closed during the lowering process. FIG. 17 is a side perspective view of the elevator and cutter 10 shown now completely lowered with the clamp 700 arms remaining opened. FIG. 18 is a side perspective view of the elevator and cutter 10 shown now completely lowered with the clamp 700 arms now closed (schematically indicated by arrows 792 in FIG. 17), and schematically indicating that the remaining string of tubulars will be raised for another cut by the cutter 10 (arrow 54).

In one embodiment is provided a method and apparatus 10 is provided for cutting generally vertically positioned tubulars 900 comprising the following steps:

(a) providing cutting apparatus 10 (e.g, FIG. 3) having:

(i) a saw 200, the saw having a rotating cutting blade 240;

(ii) a generally horizontal extender and retractor 268;

(iii) an elevator 400;

(iv) a clamp 700;

(v) a controller 800;

(vi) wherein the saw is operatively connected to the generally horizontal extender and retractor 268, the generally horizontal extender and retractor 268 is operatively connected to the elevator 400, and the clamp 700 is operatively connected to the elevator;

(vii) wherein the controller is operatively connected to the saw 200, the generally horizontal extender and retractor 268, the elevator 400, and the clamp 700;

(b) operating the controller 800 to cause the elevator 400 to vertically lift the saw 200 to a pre-defined vertical height for making a cut (e.g., FIG. 3, and from first vertical height 682 to second vertical height 686 in FIGS. 10-12);

(c) operating the controller 800 to cause the clamp 700 to clamp down at a third predefined vertical height on the tubular 900 to be cut (schematically indicated by arrows 792—see FIGS. 4-5 and 11-12);

(d) operating the controller 800 to cause rotating cutting blade 240 to rotate (e.g., FIGS. 7, and 11-13);

(e) operating the controller 800 to cause the generally horizontal extender and retractor 268 to extend the saw 200 in a generally horizontal direction (e.g., from first horizontal position 676 to second horizontal position 678 in FIGS. 11-13); and (f) separating the tubular 900 to be cut into upper 910 and lower 920 sections (e.g., FIGS. 7 and 13-14).

In FIG. 16, numeral 921 shows the top of section 920 at the cut. The draw works, crane or top drive 50 then lifts the remaining part of the tubular 900 (schematically indicated by arrow 52 in FIG. 7), namely second pipe or tubing section 920 so that another cut can be made using saw 200. The dimension 912 in FIG. 12 can be the length of first section 910. The dimension 922 in FIG. 12 can be the distance from blade 240 to deck 30.

In various embodiments, during step "b" elevator 400 can move saw 200 both vertically (e.g., FIG. 3, and from first vertical height 682 to second vertical height 686 in FIGS. 10-12), and horizontally (e.g., FIG. 3, and from third horizontal position 672 to fourth horizontal position 676 in FIGS. 9-11). Such dual vertical and horizontal motion is schematically indicated by arrows 690, 692, 693, and 694 in FIGS. 4-5 and 9-11.

In various embodiments the method can comprise the following additional steps:

(g) operating the controller 800 to cause the generally horizontal extender and retractor 268 to retract saw 200 in a generally horizontal direction (schematically indicated by arrow 699 in FIGS. 14-15);

(h) operating the controller 800 to cause the clamp 700 to unclamp lower tubular section 920 (FIGS. 6,14-15);

(i) operating the controller 800 to cause the elevator 400 to vertically lower saw 200 to the first pre-defined vertical height for making a cut (schematically indicated by arrows 695 and 696 in FIGS. 15-17); and (j) lifting lower tubular section 920 for another cut by the method and apparatus 10 (schematically indicated by arrow 54 in FIG. 18).

In various embodiments after a cut, the upper portion 910 of tubular 900 can be removed (schematically indicated by arrow 52 in FIGS. 7 and 13).

In various embodiments, before step "c", controller 800 causes clamp 700 to move from a clamped state to an open state (schematically indicated by arrows 790 in FIGS. 4 and 9)

In various embodiments generally horizontal extender and retractor 268 can supplement horizontal movement of saw 200 beyond that provided by horizontal movement from elevator 400. In various embodiments generally horizontal extender and retractor 268 can subtract from and/or cancel horizontal movement of saw 200 to that provided by horizontal movement from elevator 400.

In various embodiments operator 810 of controller 800 is located outside of the area of exposure 34 during one or more of the steps "a" through "j" of the method and apparatus 10. In various embodiments operator 810 is located outside of the area of exposure 34 during all of the steps "a" through "f" of the method and apparatus 10. In various embodiments operator 810 is located outside of the area of exposure 34 during all of the steps "g" through "h" of the method and apparatus 10. In various embodiments operator 810 is located outside of the area of exposure 34 during all of the steps "a" through "h" of the method and apparatus 10.

In various embodiments a saw 200, generally horizontal extender and retractor 268, elevator 400, and/or a clamp 700 are hydraulically powered.

In various embodiments the method includes the step of moving saw blade housing 230 is between a first lower position that is spaced away from tubular 900 (see FIG. 8) and a second, elevated position that places housing 230 next to tubular 900 (see FIG. 12).

Alternative Diamond Wire Cutter

Figure 40:
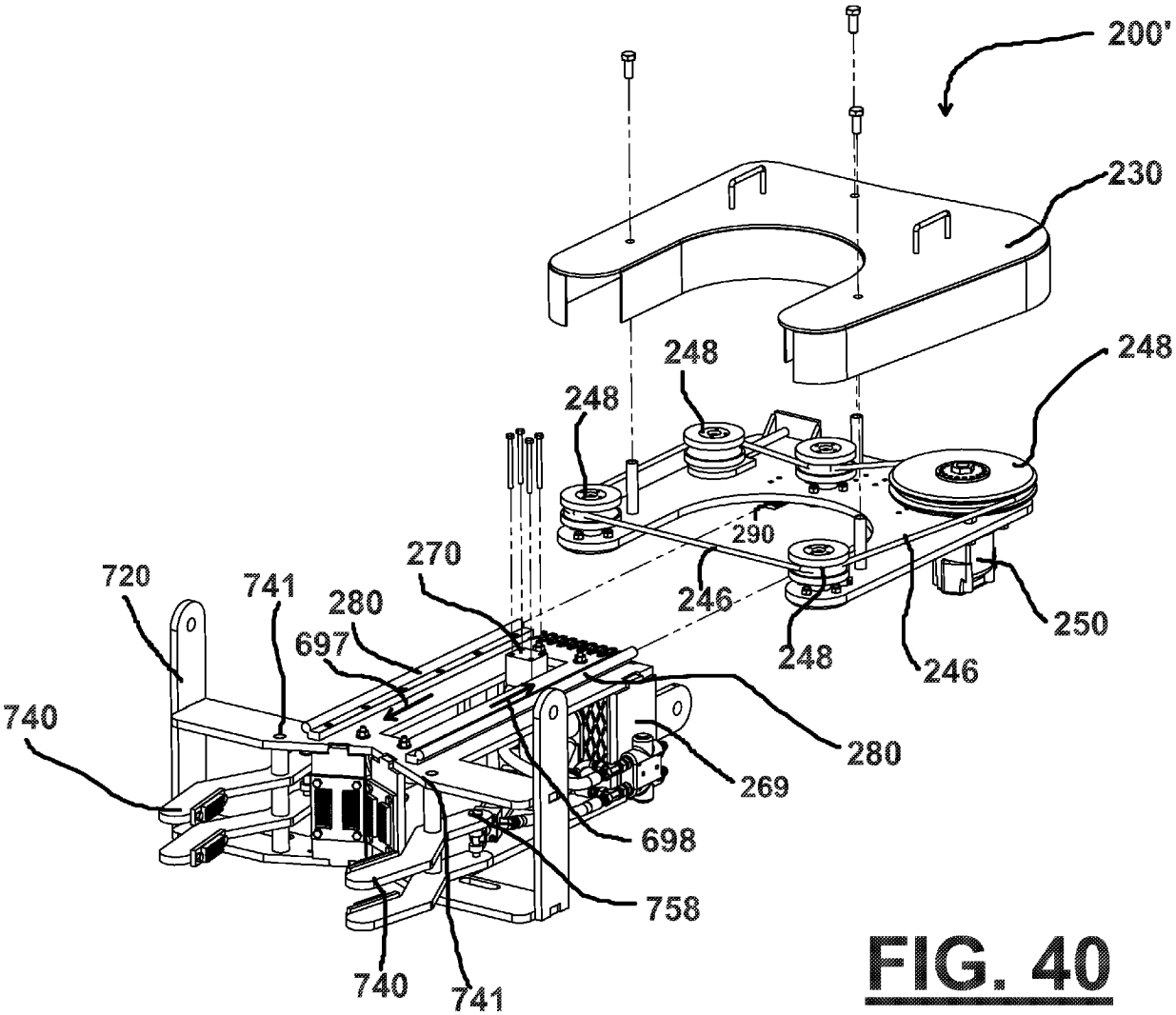
FIG. 40 is an exploded perspective view of the clamp with an alternative diamond wire cutter.

FIG. 40 is an exploded perspective view of the clamp 700 with an alternative diamond wire cutter 200'. Diamond wire cutter 200' can take the place of rotary blade cutter 200. Diamond wire cutter 200' includes diamond wire 246 operatively connected to a plurality of guide rollers 248. A motor 250 is operatively connected to a drive roller/pulley 248 which drives wire 246.

The following is Table of Reference Numerals used in this specification.

TABLE OF REFERENCE NUMERALS

| Reference Numeral | Description |
|---|---|
| 10 | cutting apparatus |
| 20 | drilling rig |
| 30 | deck |
| 32 | gimble or rotary table |
| 34 | area of exposure |
| 40 | winch |
| 44 | winch cable |
| 50 | draw works, crane, and/or top drive |
| 52 | arrow |
| 54 | arrow |
| 60 | rigging |
| 70 | water surface |
| 74 | seabed |
| 80 | riser, casing, or well bore |
| 90 | tubing or casing to be cut |
| 200 | apparatus/saw unit |
| 210 | frame |

-continued

TABLE OF REFERENCE NUMERALS

| Reference Numeral | Description |
|---|---|
| 212 | first end |
| 213 | stabilizer |
| 214 | second end |
| 230 | saw blade housing |
| 232 | opening in housing |
| 236 | base |
| 240 | saw blade |
| 244 | saw teeth |
| 246 | saw wire (e.g., diamond wire) |
| 247 | driving roller |
| 248 | plurality of driven rollers |
| 250 | motor drive |
| 260 | hydraulic actuator |
| 268 | generally horizontal extender and retractor |
| 269 | frame |
| 270 | moving portion |
| 271 | motor |
| 272 | gear |
| 274 | chain |
| 275 | arrow |
| 278 | hydraulic line |
| 280 | track |
| 281 | threaded shaft |
| 282 | first end |
| 284 | second end |
| 285 | gear |
| 286 | guiding slot |
| 287 | bearing |
| 288 | bearing |
| 290 | plurality of sliders/rollers |
| 292 | roller |
| 294 | roller |
| 300 | cylinder |
| 302 | rod/pushrod |
| 310 | hydraulic line |
| 390 | arrow |
| 392 | arrow |
| 394 | arrows |
| 400 | saw elevator assembly |
| 402 | hydraulic inputs |
| 410 | first end |
| 420 | second end |
| 450 | upper end portion |
| 470 | base |
| 472 | plurality of feet |
| 474 | plurality of eyelets |
| 500 | first pivoting support |
| 504 | upper pivot |
| 508 | lower pivot |
| 550 | second pivoting support |
| 554 | upper pivot |
| 558 | lower pivot |
| 600 | hydraulic actuator |
| 602 | pivot point |
| 604 | arrow |
| 610 | arm |
| 612 | pivot point |
| 620 | lower pivot |
| 630 | upper pivot |
| 670 | measuring point |
| 672 | dimension |
| 674 | dimension |
| 676 | dimension |
| 678 | dimension |
| 680 | dimension |
| 682 | dimension |
| 684 | dimension |
| 690 | arrow |
| 691 | arrow |
| 692 | arrow |
| 693 | arrow |
| 694 | arrow |
| 695 | arrow |
| 696 | arrow |
| 700 | hydraulic clamp/clamp apparatus |

-continued

TABLE OF REFERENCE NUMERALS

| Reference Numeral | Description |
|---|---|
| 712 | opening |
| 720 | body |
| 730 | hinge |
| 740 | plurality of opposed pivoting arms |
| 741 | pivot/pin connection |
| 742 | friction insert |
| 744 | plurality of friction inserts |
| 750 | cylinder |
| 751 | pivot/pin connection |
| 754 | pushrod |
| 755 | arrow |
| 756 | arrow |
| 758 | pinned connection |
| 790 | arrow |
| 792 | arrow |
| 794 | arrows |
| 800 | control panel/console |
| 810 | operator |
| 820 | controls/levers |
| 830 | instruments |
| 850 | power supply |
| 900 | pipeline/tubing string/tubular |
| 910 | first pipe/tubing section |
| 911 | bottom of cut joint |
| 912 | dimension |
| 914 | arrow |
| 919 | connection between joints of tubing |
| 920 | second pipe/tubing section |
| 921 | top of joint cut |
| 922 | dimension |
| 930 | upper or cut section |
| 940 | lower section |
| 950 | arrow |
| 954 | arrow |
| 960 | retainer |
| 964 | brace portion |
| 990 | arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of salvaging an elongated oil well tubular that extends downwardly from an oil well platform, comprising the steps of:

a) supporting the tubular in a generally vertical position;

b) placing a cutting apparatus next to the tubular, said cutting apparatus including a frame that supports a lifting device and a rotary cutter, wherein the frame includes a base and a lift section pivotally attached to the base, and a hydraulic cylinder having a pushrod, wherein the lift section has one or more rails;

c) using the lifting device to move the rotary cutter from a first position to a second position that is higher than said first position and that is closer to the tubular than the said first position and extending the hydraulic cylinder to elevate the lift section;

d) wherein the rotary cutter travels in an arcuate path when moving from said first position to said second position;

e) moving the cutter along a selected path to cut the tubular and moving the cutter upon the rails;

f) elevating the tubular after step “e” and;

g) repeating steps “c” through “f” multiple times.

2. The method of claim 1, wherein the rotary cutter of step "b" is hydraulically powered.

3. The method of claim 2 further comprising operating the lifting device from a remote location with a hydraulic control panel.

4. The method of claim 1 wherein the lifting device of step "b" is hydraulically powered.

5. The method of claim 1 wherein the cutter includes a rotary disk connected to a hydraulic motor, a pair of spaced apart rails on the lift section, wherein the disk is positioned in between the rails and further comprising moving the cutter upon the spaced apart rails in step "e'.

6. The method of claim 1 further comprising a clamping device mounted on the frame and clamping the tubular before step "e".

7. The method of claim 6 further comprising using the clamp device to press the tubular against the lift section.

8. The method of claim 6 wherein the clamping device includes an upper pair of clamp arms and a lower pair of clamp arms.

9. The method of claim 1 further comprising supporting a clamping device with the lift section.

10. The method of claim 9 further comprising using the clamp device to press the tubular against the lift section.

11. A method of salvaging an elongated oil well tubular that extends downwardly from an oil well platform, comprising the steps of:

a) supporting the tubular in a generally vertical position;

b) placing a cutting apparatus next to the tubular, said cutting apparatus including a frame that supports a lifting device and a rotary cutter;

c) using the lifting device to move the rotary cutter from a first position to a second position that is higher than said first position and that is closer to the tubular than the said first position;

d) wherein the rotary cutter travels along an inclined path that gradually elevates the cutter and moves the cutter closer and closer to the tubular;

e) moving the cutter along a selected path to cut the tubular;

f) elevating the tubular after step "e" and;

g) repeating steps "c" through "f" multiple times, wherein the lift section has one or more rails and further comprising moving the cutter upon the rails in step "e".

12. The method of claim 11 wherein the lifting device of step "b" is hydraulically powered.

13. The method of claim 11 further comprising operating the lifting device from a remote location with a hydraulic control panel.

14. The method of claim 11 wherein the lifting device includes a base and a lift section pivotally attached to the base.

15. The method of claim 14 wherein the frame includes a plurality of links that each connect between the base and the lift section.

16. The method of claim 14 further comprising supporting a clamping device with the lift section.

17. The method of claim 11 further comprising a hydraulic cylinder having a pushrod and step "c" includes extending the hydraulic cylinder to elevate the lift section.

18. The method of claim 11 wherein in step "d" both the cutter and the clamping device move along inclined paths.

19. The method of claim 11 further comprising a clamping device mounted on the frame and clamping the tubular before step "e".

* * * * *